US011256210B2

(12) United States Patent
Luo et al.

(10) Patent No.: US 11,256,210 B2
(45) Date of Patent: Feb. 22, 2022

(54) PROCESSING CARTRIDGE

(71) Applicant: Ninestar Corporation, Zhuhai (CN)

(72) Inventors: Qin Luo, Zhuhai (CN); Gerning Ding, Zhuhai (CN); Likun Zeng, Zhuhai (CN); Hui Cao, Zhuhai (CN); Miaoling Yang, Zhuhai (CN); Lianjun Wu, Zhuhai (CN); Shuchun Dai, Zhuhai (CN)

(73) Assignee: NINESTAR CORPORATION, Zhuhai (CN)

( * ) Notice: Subject to any disclaimer, the term of this patent is extended or adjusted under 35 U.S.C. 154(b) by 0 days.

(21) Appl. No.: 17/013,474

(22) Filed: Sep. 4, 2020

(65) Prior Publication Data

US 2020/0401077 A1 Dec. 24, 2020

Related U.S. Application Data

(63) Continuation of application No. PCT/CN2019/076201, filed on Feb. 26, 2019.

(30) Foreign Application Priority Data

Mar. 6, 2018 (CN) ..... 201820309123.7
Mar. 7, 2018 (CN) ..... 201820317741.6
(Continued)

(51) Int. Cl.
*G03G 21/18* (2006.01)

(52) U.S. Cl.
CPC ..... *G03G 21/186* (2013.01); *G03G 21/1864* (2013.01)

(58) Field of Classification Search
CPC ..... G03G 21/186; G03G 21/1864
See application file for complete search history.

(56) References Cited

U.S. PATENT DOCUMENTS 8,437,669 B2 * 5/2013 Morioka ..... F16D 3/04 399/279
9,651,915 B2 * 5/2017 Morgan ..... G03G 21/181
(Continued)

FOREIGN PATENT DOCUMENTS

CN 101907858 A 12/2010
CN 102207727 A 10/2011
(Continued)

OTHER PUBLICATIONS

The World Intellectual Property Organization (WIPO) International Search Report for PCT/CN2019/076201 dated May 29, 2019 17Pages (including translation).

*Primary Examiner* — Francis C Gray
(74) *Attorney, Agent, or Firm* — Anova Law Group, PLLC

(57) ABSTRACT

A processing cartridge is provided. The processing cartridge can be detachably mounted in an electronic imaging device including a driving component for transmitting rotating force. The processing cartridge includes a housing and a force receiving element. The force receiving element including force receiving parts is disposed at one side of the housing and is rotatably supported by the housing. The force receiving parts are disposed at an end portion of the force receiving element along a circumferential direction of the force receiving element and protrude in a direction of a rotation axis of the force receiving element. When the processing cartridge is mounted in the electronic imaging device along a predetermined mounting direction, the force receiving parts and the driving component are engaged with each other to transmit the force.

15 Claims, 34 Drawing Sheets

(30) Foreign Application Priority Data

| | | |
|---|---|---|
| Mar. 12, 2018 | (CN) | 201820339732.7 |
| Mar. 14, 2018 | (CN) | 201820350884.7 |
| Jun. 1, 2018 | (CN) | 201820847774.1 |
| Jun. 5, 2018 | (CN) | 201820866195.1 |
| Aug. 1, 2018 | (CN) | 201821225870.9 |
| Aug. 8, 2018 | (CN) | 201821276706.3 |
| Aug. 16, 2018 | (CN) | 201821329545.7 |
| Nov. 5, 2018 | (CN) | 201811309019.9 |

(56) References Cited

U.S. PATENT DOCUMENTS

| | | | | |
|---|---|---|---|---|
| 10,338,513 | B1 † | 7/2019 | Hu | |
| 2009/0317132 | A1 * | 12/2009 | Asanuma | G03G 21/1814 399/117 |
| 2010/0034561 | A1 * | 2/2010 | Batori | G03G 15/751 399/167 |
| 2012/0183331 | A1 * | 7/2012 | Huang | G03G 15/757 399/167 |
| 2017/0300007 | A1 † | 10/2017 | Lin | |
| 2018/0113417 | A1 * | 4/2018 | Rong | G03G 21/1864 |
| 2018/0284686 | A1 * | 10/2018 | Matsuoka | G03G 21/1864 |

FOREIGN PATENT DOCUMENTS

| | | | |
|---|---|---|---|
| CN | 106444316 | A | 2/2017 |
| CN | 206773405 | U | 12/2017 |
| CN | 208255643 | U | 12/2018 |

* cited by examiner
† cited by third party

PROCESSING CARTRIDGE

CROSS-REFERENCE TO RELATED APPLICATIONS

This application is a continuation application of PCT Patent Application No. PCT/CN2019/076201, filed on Feb. 26, 2019, which claims the priority of Chinese Patent Application No. 201820309123.7, filed on Mar. 6, 2018, Chinese Patent Application No. 201820317741.6, filed on Mar. 7, 2018, Chinese Patent Application No. 201820339732.7, filed on Mar. 12, 2018, Chinese Patent Application No. 201820350884.7, filed on Mar. 14, 2018, Chinese Patent Application No. 201820847774.1, filed on Jun. 1, 2018, Chinese Patent Application No. 201820866195.1, filed on Jun. 5, 2018, Chinese Patent Application No. 201821225870.9, field on Aug. 1, 2018, Chinese Patent Application No. 201821276706.0, filed on Aug. 8, 2018, Chinese Patent Application No. 201821329545.7, filed on Aug. 16, 2018, and Chinese Patent Application No. 201811309019.9, filed on Nov. 5, 2018, the contents of all of which are incorporated herein by reference in their entirety.

TECHNICAL FIELD

The present disclosure generally relates to the field of imaging devices and, more particularly, relates to a processing cartridge.

BACKGROUND

An electronic imaging device (such as an electrophotographic copy device, a laser printer, an electrophotographic printer, a facsimile machine, and a text processor), is a device that forms images on a recording material by an electrophotographic imaging/processing technique. Electronic imaging devices typically include monochrome electronic imaging devices and color electronic imaging devices.

An electronic imaging device typically includes a main body and a processing cartridge. The processing cartridge is mounted into the main body detachably. The processing cartridge includes sidewalls at two ends along a longitudinal direction. Rotating elements may be included inside the processing cartridge. The rotating elements may be one or more of a photosensitive element, a developing element, a charging element, a toner feeding element, and a gear element. The rotating elements is connected to a force receiving element and receives a driving force from the force receiving element. The force receiving element typically is disposed at a sidewall of the processing cartridge and receives the driving force from the main body of the electronic imaging device.

The processing cartridge typically is mounted into the electronic imaging device along one direction. The force receiving element is engaged with a driving component disposed in the electronic imaging device to receive the driving force when the processing cartridge is mounted at a corresponding position. However, this may cause some problems. For example, in Chinese Patent No. CN201532527U, when mounting the processing cartridge into the electronic imaging device, the driving component in the electronic imaging device touches the force receiving element on the processing cartridge, and makes the force receiving element retract then protrude along a direction of a rotation axis of the force receiving element in order to engage with the driving component of the electronic imaging device. When removing the processing cartridge from the electronic imaging device, a user is required to forcibly take out the processing cartridge from the electronic imaging device. Since the driving component and the force receiving element are engaged together, the driving component and the force receiving element cannot be disengaged easily from each other and the processing cartridge cannot be taken out easily. In the meanwhile, friction damage can also be formed between the driving component and the force receiving element. In addition to the problems occurred when removing the processing cartridge from the electronic imaging device, when mounting the processing cartridge, ends of the force receiving element and the driving components can easily interfere with each other, and the processing cartridge cannot be mounted in place easily.

Therefore, there is a need to provide a processing cartridge that can be mounted into and removed from an electronic imaging device smoothly.

SUMMARY

The present disclosure provides a processing cartridge. The processing cartridge may have a relatively simple structure. And when the processing cartridge is mounted into the electronic imaging device, an interference between the processing cartridge and the electronic imaging device may be avoided, such that the processing cartridge is capable to be mounted into and removed from an electronic imaging device smoothly.

One aspect of the present disclosure provides a processing cartridge. The processing cartridge can be detachably mounted in an electronic imaging device including a driving component for transmitting rotating force. The processing cartridge includes a housing and a force receiving element. The force receiving element including force receiving parts is disposed at one side of the housing, and is rotatably supported by the housing. The force receiving parts are disposed at an end portion of the force receiving element along a circumferential direction of the force receiving element, and protrude in a direction of a rotation axis of the force receiving element. When the processing cartridge is mounted in the electronic imaging device along a predetermined mounting direction, the force receiving parts and the driving component are engaged with each other to transmit the force.

Optionally, the force receiving element includes two force receiving parts. The two force receiving parts are disposed at the end portion of the force receiving element symmetrically with respect to the circumferential direction of the force receiving element, and protrude in the direction of the rotation axis of the force receiving element.

When the processing cartridge is mounted in the electronic imaging device in the predetermined mounting direction, if a projection of the driving component in the mounting direction is less than or equal to a gap between the two force receiving parts, the force receiving parts are capable of engaging with the driving component; if the projection of the driving component in the mounting direction is larger than the gap between the two force receiving parts, the force receiving parts are capable of abutting against the driving component, and are capable of engaging with the driving component by a rotation of the driving component.

Optionally, a hub is disposed in the housing. The force receiving element is disposed in the hub along an axis direction of the hub. The force receiving element is movably connected to the hub in a direction perpendicular to the axis direction of the hub. When the processing cartridge is mounted to the electronic imaging device in the mounting direction and the projection of the driving component in the mounting direction is larger than the gap between the two force receiving parts, the force receiving parts abut against the driving component and make the force receiving element move in the direction perpendicular to the axis of the hub.

Optionally, when the processing cartridge is mounted to the electronic imaging device in the mounting direction, the driving component abuts against the force receiving parts and make the axis of the force receiving element move in a direction away from the axis of the hub; and the driving component rotates to make the axis of the force receiving element shift in a direction closer to the axis of the hub, and make the force receiving parts engage with the driving component.

Optionally, the force receiving element is connected to the hub through a cross-coupling structure. The cross-coupling structure includes an intermediate connection component and an end connection component. One end of the intermediate connection component is slidably connected to the force receiving element, and another end of the intermediate connection component is slidably connected to the end connection component. The end connection component is connected to the hub.

Optionally, the processing cartridge further includes a first elastic component. One end of the first elastic component abuts against the housing or a part fixed with respect to the housing, and another end of the first elastic component abuts against the force receiving element. The first elastic component is capable of applying pulling force or pushing force on the force receiving element.

Optionally, the first elastic component is a tension spring, a spring, or a torsion spring.

Optionally, the end connection component includes protruding posts on an outer circumference of the end connection component. The hub includes hub force receiving parts along an inner circumferential direction. The protruding posts abut against the hub force receiving parts to transmit force. The protruding posts protrude outwards in a radial direction of the end connection component. The hub force receiving parts are disposed in the inner circumferential direction of the hub. A second elastic component is further disposed between the end connection component and the hub. When the end connection component and the hub are not subjected to external force, the second elastic component prevents the protruding posts and the hub force receiving parts from abutting against each other.

Optionally, a mounting part is further disposed on the outer circumference of the end connection component. The second elastic component is a torsion spring component. One end of the torsion spring component is connected to the mounting part, and another end abuts against the hub.

Optionally, the processing cartridge further includes an end cover. The end cover is disposed on one side of the housing and the first elastic component is disposed on the end cover. One end of the first elastic component is connected to the end cover, and another end is connected to the force receiving element.

Optionally, when the processing cartridge is mounted into the electronic imaging device, the force receiving element is engaged with the driving component. When the processing cartridge is removed from the electronic imaging device, the housing of the processing cartridge is tilted with respect to an axis of the driving component to remove engagement between the force receiving element and the driving component.

when the processing cartridge is mounted into the electronic imaging device, an interference between the processing cartridge and the electronic imaging device may be avoided, such that the processing cartridge is capable to be mounted into and removed from an electronic imaging device smoothly.

Other aspects or embodiments of the present disclosure can be understood by those skilled in the art in light of the description, the claims, and the drawings of the present disclosure.

BRIEF DESCRIPTION OF THE DRAWINGS

Reference will now be made in detail to exemplary embodiments of the disclosure, which are illustrated in the accompanying drawings. Hereinafter, embodiments consistent with the disclosure will be described with reference to drawings. The following drawings are merely examples for illustrative purposes according to various disclosed embodiments and are not intended to limit the scope of the present disclosure. It should be understood by those skilled in the art that the present disclosure is not limited to the specific embodiments described herein and that various other obvious changes, rearrangements, and substitutions will occur to those skilled in the art without departing from the scope of the disclosure.

DETAILED DESCRIPTION

Figure 1:
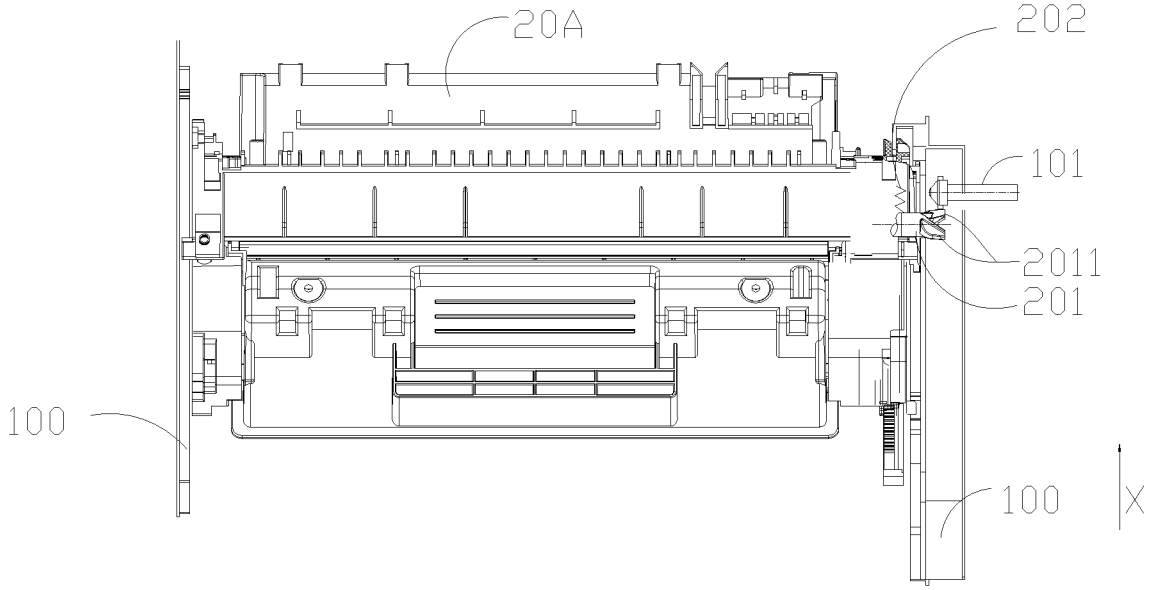
FIG. 1 illustrates a state of an exemplary processing cartridge not meeting a dead point provided by an embodiment of the present disclosure.

Reference will now be made in detail to exemplary embodiments of the disclosure, which are illustrated in the accompanying drawings. Hereinafter, embodiments consistent with the disclosure will be described with reference to drawings. In the drawings, the shape and size may be exaggerated, distorted, or simplified for clarity. Wherever possible, the same reference numbers will be used throughout the drawings to refer to the same or like parts, and a detailed description thereof may be omitted.

Further, in the present disclosure, the disclosed embodiments and the features of the disclosed embodiments may be combined under conditions without conflicts. It is apparent that the described embodiments are some but not all of the embodiments of the present disclosure. Based on the disclosed embodiments, persons of ordinary skill in the art may derive other embodiments consistent with the present disclosure, all of which are within the scope of the present disclosure.

Moreover, the present disclosure is described with reference to schematic diagrams. For the convenience of descriptions of the embodiments, the cross-sectional views illustrating the device structures may not follow the common proportion and may be partially exaggerated. Besides, those schematic diagrams are merely examples, and not intended to limit the scope of the disclosure. Furthermore, a three-dimensional (3D) size including length, width and depth should be considered during practical fabrication.

Figure 2:
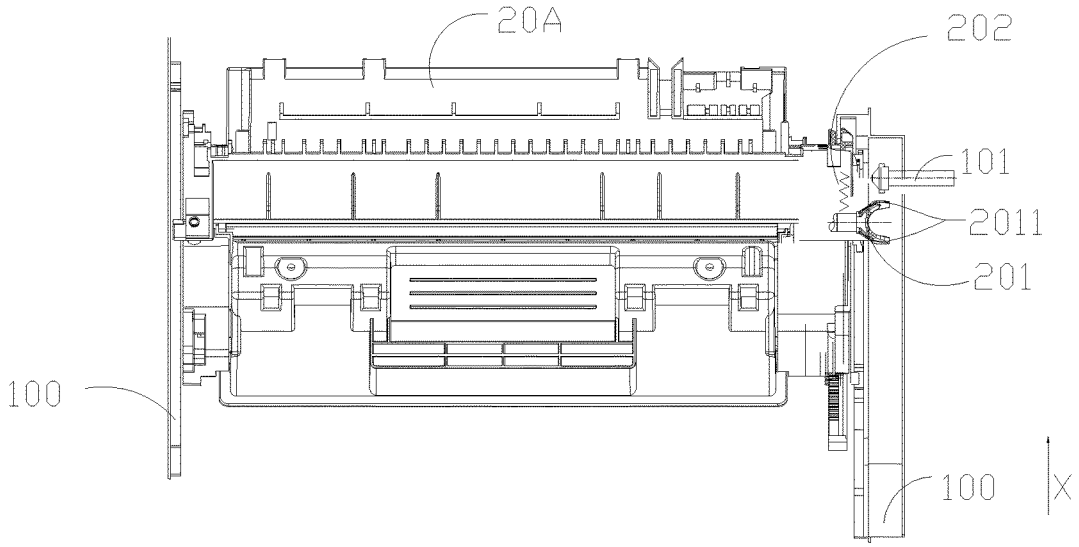
FIG. 2 illustrates a state of an exemplary processing cartridge meeting a dead point provided by another embodiment of the present disclosure.
Figure 3:
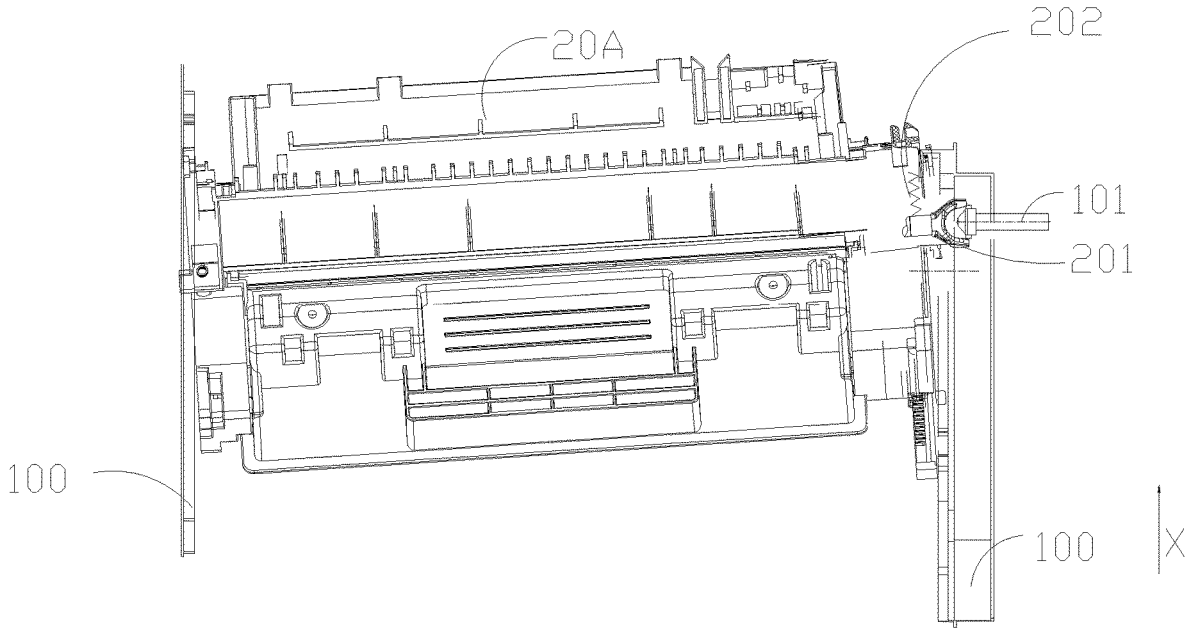
FIG. 3 illustrates a state of an exemplary processing cartridge in a removing process provided by another embodiment of the present disclosure.

One embodiment of the present disclosure provides a processing cartridge. As illustrated in FIGS. 1-3, the processing cartridge 20A may be mounted into an electronic imaging device further including a main body 100. The main body 100 may include a driving component 101. The processing cartridge 20A may include a force receiving element 201. When mounting the cartridge 20A into the electronic imaging device, the force receiving element 201 may engage with the driving component 101 in the electronic imaging device, to transmit a driving force. The force receiving element 201 may be coupled to an elastic component 202, and the elastic component may constantly apply a pulling force or a pushing force on the force receiving element 201. The force receiving element 201 may be capable of translating a plane on one side of the processing cartridge 20A. In one embodiment, the elastic component 202 may be a tension spring and correspondingly the elastic component 202 may apply a pulling force to the force receiving element 201. In some other embodiments, the elastic component 202 may be a spring or a torsion spring, to apply a pushing force on the force receiving element 201. When the elastic component 202 is a spring or a tension spring, to prevent the spring or the tension spring from interfering with the rotation of the force receiving element 201, a bracket may be provided. The bracket may rotate relative to the force receiving element 201. An end of the spring or the tension spring may be connected to the bracket. Correspondingly, the spring or the tension spring may apply an elastic force to the force receiving element indirectly through the bracket. Sidewalls may be disposed at two ends of the processing cartridge 20A along a length direction of the processing cartridge 20A. One end of the elastic component 202 may be connected to the force receiving element 201 or elastically act on the force receiving element 201, and another end of the elastic component 202 may be connected to a housing of the processing cartridge 20A to make the force receiving element 201 move horizontally along a direction perpendicular to the sidewalls.

As illustrated in FIG. 1, when mounting the processing cartridge 20A into the main body 100 along a direction X, a pair of force receiving parts 2011 at an end of the force receiving element 201 may include an opening and a penetrating direction of the opening may be parallel to the mounting direction X. Correspondingly, the force receiving parts 2011 may avoid the driving component 101 of the imaging device in the mounting direction of the processing cartridge, and the driving component 101 and the force receiving element 201 may be engaged directly. The elastic component 202 may have no deformation or a small deformation, and a position of the elastic component 202 may be referred to as a first position. When the electronic imaging process starts working, each rotating component in the processing cartridge may rotate normally.

In some embodiments, when mounting the processing cartridge 20A into the main body 100 along the direction X, the driving component 101 and the force receiving element 201 cannot be engaged directly and the driving component 101 and the force receiving element 201 may interfere with each other, as illustrated in FIG. 2. The force receiving element 201 may abut against the driving component 101, and may move along a direction perpendicular to the sidewalk. The elastic component 202 may have a larger deformation in comparison with the first position, and the current position of the elastic component 202 may be referred to as a second position. When the electronic imaging process starts working, the driving component 101 may rotate, and the driving component 101 and the force receiving element 201 may be engaged with each other in at least one position during the rotation of the driving component 101. Then the force receiving element 201 may be engaged with the driving component 101 because of the elastic component 202, and each rotating component in the processing cartridge may rotate normally.

As illustrated in FIG. 3, when removing the processing cartridge 20A from the main body 100 along a direction opposite to the X direction, an end of the processing cartridge 201 away from the force receiving element 201 may be tilted with respect to a take-out position, to disengage the force receiving element 201 from the driving component 101. Then the processing cartridge 20A may be removed from the main body 100.

The force receiving element 201 may be connected to a rotating roller through a gear train structure, a pulley group structure, a multiple-link-rod structure, or any other suitable structure.

A mechanism for rotatably resetting the force receiving element 201 relative to a housing of the processing cartridge may be disposed to make the process in the present disclosure smooth.

Figure 4:
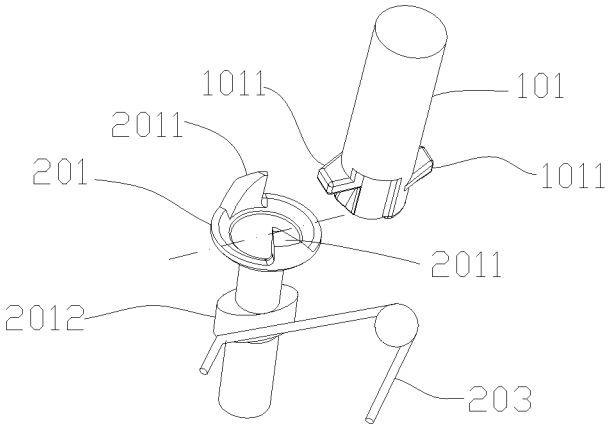
FIG. 4 illustrates a structure of an exemplary processing cartridge provided by another embodiment of the present disclosure.

As illustrated in FIG. 4, the force receiving element 201 may be configured so the force receiving element 201 can rotate relative to the housing of the processing cartridge 20A. A pair of force receiving parts 2011 protruding radially along the force receiving element 201 may be disposed at one end of the force receiving element 201. A direction between the pair of force receiving parts 2011 may be a penetrating direction, and a portion of the driving component 101 of the electronic imaging device may be disposed between the pair of force receiving parts 2011. An elastic part 203 may be disposed fixedly relative to the processing cartridge 20A. The elastic part 203 may be a torsion spring, a spring piece, or a spring. The elastic part 203 may contact the force receiving element 201 constantly. The force receiving element 201 may include a protrusion part 2012 on a shaft portion of the force receiving element 201 along a radial direction of the shaft portion, and the protrusion part 2012 may be a non-circular structure. The elastic part 203 may make the penetration direction between the pair of force receiving parts 2011 parallel to the mounting direction of the processing cartridge constantly when there is no external force on the force receiving element 201.

The driving component 101 in the electronic imaging device may include a transmission part 1011 along a radial direction of the driving component 101, and the transmission part 1011 may be engaged with the pair of force receiving parts 2011 of the force receiving element 201 to transmit the force. In one embodiment, when mounting the processing cartridge 20A into the electronic imaging device, a projection of the transmission part 1011 of the driving component 101 along the mounting direction of the processing cartridge 20A may not exceed a space between the pair of force receiving parts 2011 of the force receiving element 201 along the penetration direction. Correspondingly, the processing cartridge can be mounted into the right position and the force receiving element 201 can be located in a position coaxial with the driving component 101.

In another embodiment, when mounting the processing cartridge 20A into the electronic imaging device, a projection of the transmission part 1011 of the driving component 101 along the mounting direction of the processing cartridge 20A may exceed a space between the pair of force receiving parts 2011 of the force receiving element 201 along the penetration direction. An end of the force receiving element 201 may interfere with the transmission part 1011 of the driving component 101. The force receiving element 201 may move along a direction perpendicular to an axial line of the force receiving element 201 relative to the housing of the processing cartridge, and cannot be engaged with the driving component 101 temporarily. After the processing cartridge can be mounted into the right position, a motor in the electronic imaging device may be turned on to make the driving component 101 rotate. After the driving component 101 rotates some time, the force receiving element 201 and the driving component 101 may be engaged with each other. The driving component 101 may have a structure that can extend and contract elastically along a direction parallel to its own rotation axis, to make the engagement between the force receiving element 201 and the driving component 101 easier.

When removing the processing cartridge 20A from the main body 100 along a direction opposite to the X direction, an end of the processing cartridge 20A away from the force receiving element 201 may be tilted with respect to a take-out position, to disengage the force receiving element 201 from the driving component 101. Then the processing cartridge 20A may be removed from the main body 100. After disengaging the force receiving element 201 from the driving component 101, the force receiving element 201 may rotate back to the original position by the elastic part 203.

Figure 5:
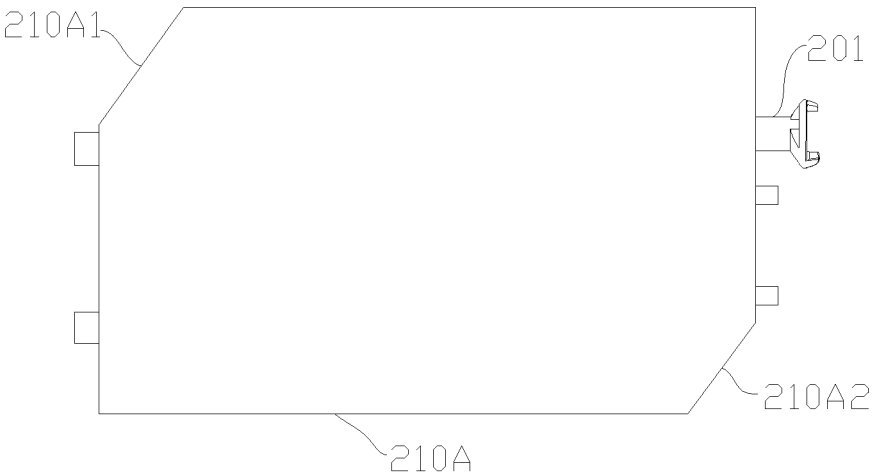
FIG. 5 illustrates a structure of another exemplary processing cartridge provided by another embodiment of the present disclosure.
Figure 6:
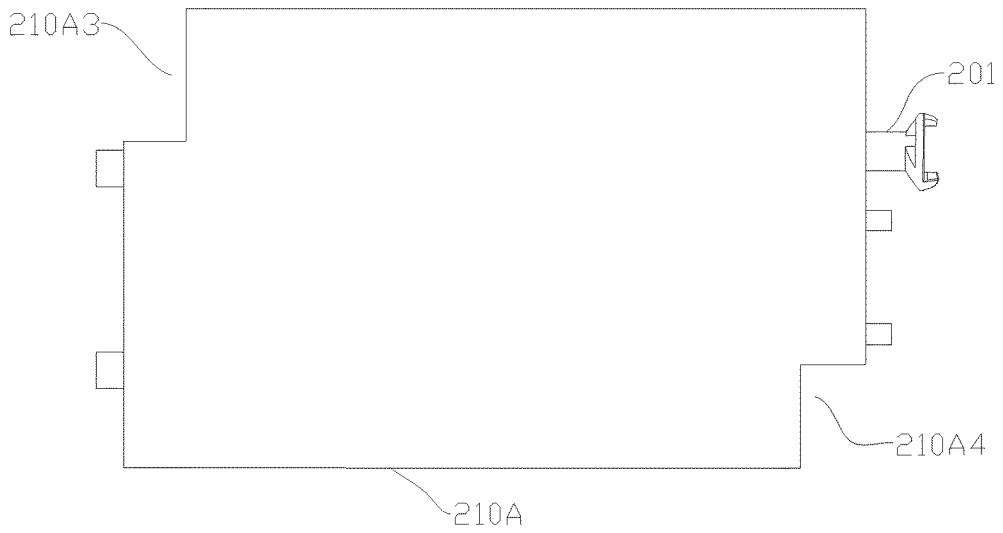
FIG. 6 illustrates a structure of another exemplary processing cartridge provided by another embodiment of the present disclosure.

As illustrated in FIGS. 5-6, to prevent the tilted processing cartridge from interfering with sidewalls of the electronic imaging device when removing the processing cartridge 20A from the electronic imaging device, tilted surfaces 201A1 and 201A2 tilted relative to a longitudinal direction of the housing 210A of the processing cartridge, or recesses 210A3 and 210A4, may be disposed at longitudinal sidewalk of the housing 210A of the processing cartridge 20A.

Following different embodiments of the present disclosure will be discussed.

Figure 7:
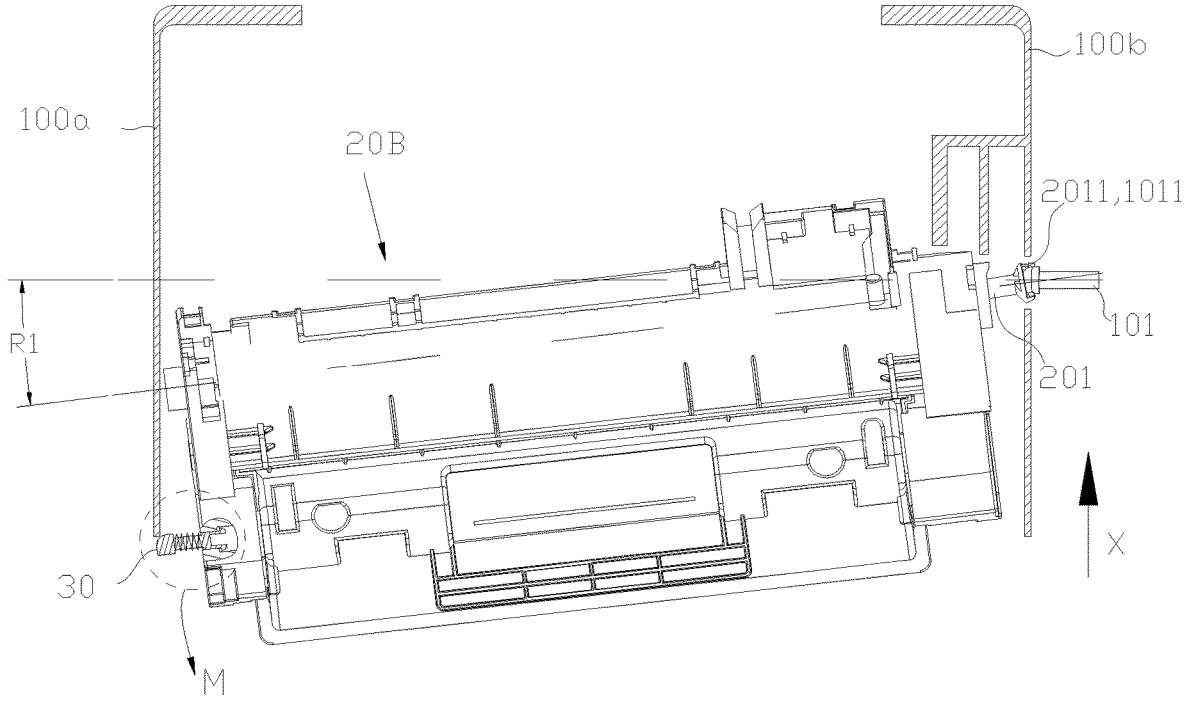
FIG. 7 illustrates a state of an exemplary processing cartridge being mounted into an imaging device provided by another embodiment of the present disclosure.

In some embodiments, the force receiving element in the processing cartridge may be fixed relative to the processing cartridge. When mounting the processing cartridge into the electronic imaging device, the processing cartridge may be tilted relative to the mounting direction of the processing cartridge. As illustrated in FIG. 7, the mounting direction of the processing cartridge may be an X direction. When the entire processing cartridge is tilted relative to the mounting direction X, the force receiving element may bypass the ends of the driving component, to avoid interference with the driving component.

The processing cartridge may include two sides along a longitudinal direction. The longitudinal direction of the processing cartridge may be a direction perpendicular to the mounting direction X. The force receiving element may be disposed at one side of the processing cartridge along the longitudinal direction referred to as a first side, and another side of the processing cartridge may be referred to as a second side. The first side may be closer to the driving component of the electronic imaging process. When the entire processing cartridge is tilted relative to the mounting direction X, the processing cartridge and the direction perpendicular to the mounting direction X may form an angle R1. The first side may be closer to an inside of the electronic imaging device than the second side, that is, the first side may be at a front of the mounting direction X of the processing cartridge). The second side may be far away from the inside of the electronic imaging device than the first side, that is, the second side may be at a rear of the mounting direction X of the processing cartridge.

When the processing cartridge is mounted to a certain extent, the processing cartridge may be gradually aligned and the inclining angle R1 may gradually decrease. When the processing cartridge is mounted at the right position, the processing cartridge may be approximately perpendicular to the mounting direction X of the processing cartridge and the force receiving element may engage with the driving component.

The processing cartridge may further include a tilt assist part, for making the processing cartridge is tilted relative to the mounting direction when mounting the processing cartridge.

Figure 8:
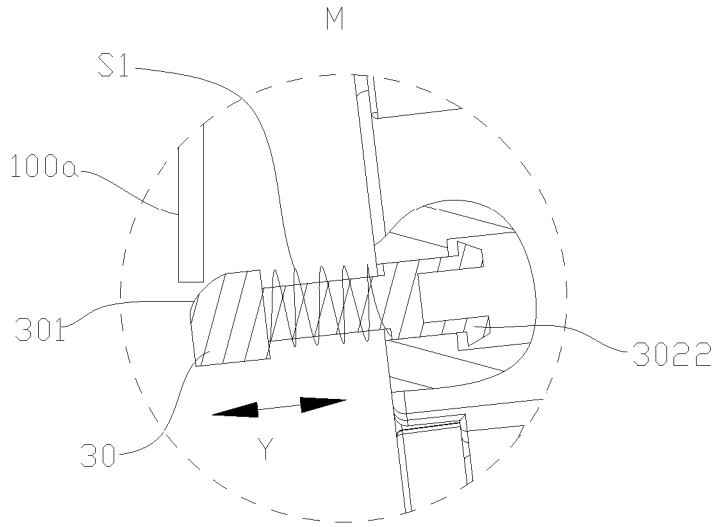
FIG. 8 illustrates a local view of an exemplary processing cartridge provided by another embodiment of the present disclosure.

Another embodiment of the present disclosure provides a processing cartridge 20B illustrated in FIG. 7 and FIG. 8 which is a local magnification of FIG. 7. A tilt assist part may be disposed on the second side of the processing cartridge 20B. The tilt assist part may include a sliding part 30 that can slide and is disposed on the processing cartridge. The sliding part 30 may be disposed on the second side of the cartridge, and may protrude outwards along a longitudinal direction of the processing cartridge. The sliding part may be engaged with the housing of the processing cartridge by a snap. The inclining assist part may further include an elastic part S1. The elastic part S1 may apply an outward pushing force to the sliding part 30. In one embodiment, the elastic part S1 may be a spring. One end of the spring may be abutted against the sliding part 30, and another end of the sprig may be abutted against the housing of the processing cartridge. One side of the sliding part 30 close to the inside of the electronic imaging device may include an arc surface or a tilted surface 301. When mounting the processing cartridge 20B into the electronic imaging device, the sliding part 30 may be abutted against the sidewall of the electronic imaging device since the sliding part 30 may protrude outwards from the housing of the processing cartridge 20B. Correspondingly, the first side of the processing cartridge may be tilted toward the inside of the electronic imaging device because of mounting inertia. The surface 301 of the sliding part 30 may be abutted against a sidewall 100*a* of the electronic imaging device, and the sliding part 30 may be pushed to retract toward the inside of the processing cartridge along the longitudinal direction of the processing cartridge. Correspondingly, in the mounting process, the processing cartridge may be aligned gradually. When the processing cartridge is mounted at the right position, the force receiving element 201 may be engaged with the driving component 101.

When removing the processing cartridge from the electronic imaging device, the processing cartridge may be tilted and taken out. Since the force receiving element 201 may be engaged with the driving component 101, the second side of the processing cartridge may be firstly tilted relative to the direction perpendicular to the X direction and along the removing direction because of the removing inertia. The entire processing cartridge may be tilted relative to the direction perpendicular to the mounting direction X, and the force receiving element 201 may be disengaged with the driving component 101, to allow the processing cartridge to be removed from the electronic imaging device. The sliding part 30 may protrude outwards because of the restoring force of the spring.

Figure 9:
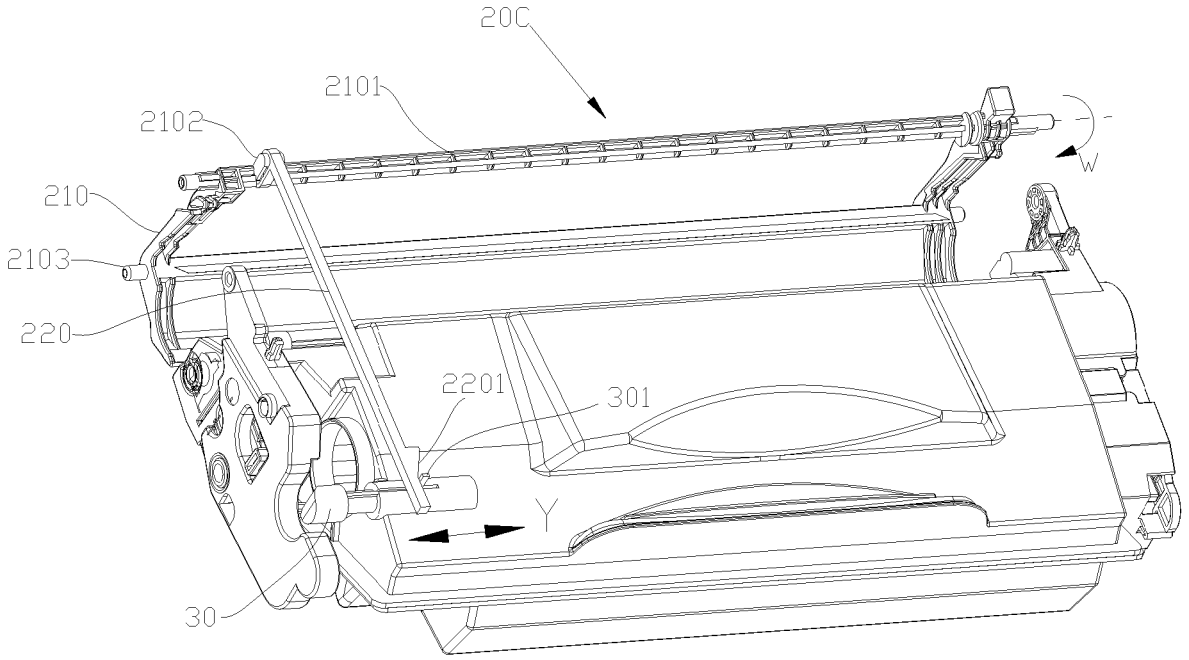
FIG. 9 illustrates a structure of an exemplary processing cartridge provided by another embodiment of the present disclosure.

Another embodiment of the present disclosure also provides a processing cartridge 20C illustrated in FIG. 9. In comparison to the previous embodiments, the sliding part 30 may retract toward the inside of the processing cartridge not by contacting with the sidewall 100*a* of the electronic imaging device, in the present embodiment. A protection cover that can move relative to the housing of the processing cartridge may be disposed on the processing cartridge to provide a sliding force to the sliding part.

As illustrated in FIG. 9, the processing cartridge 20C may include a photosensitive element, and a protection cover 210 may be disposed at a back end of the processing cartridge 20C and along the longitudinal direction of the processing cartridge 20C. A shell of the protection cover 201 may open or close, to block or not block a surface of the photosensitive element. The protection cover 201 may further include an axial part 2101. The axial part 2101 may be supported by the housing of the processing cartridge. The protection cover 210 may rotate about the axial part 2101, by this way, the protection cover 210 can block or not block a surface of the photosensitive element. The protection cover 210 may include a protruding part 2102 along a direction perpendicular to the axial part 2101 and an acted part 2103. When the processing cartridge is mounted into the electronic imaging device, the acted part 2103 of the protection cover 210 may be abutted against the inside of the electronic imaging device, to make the protection cover 210 rotate around the axial part 2101 and the protruding part 2102 swing with the axial part 2101. The protection cover 210 may further coordinate with a connection rod 220 with a tilt surface 2201. The connection rod 220 may move the sliding part 30 through the tilt surface 2201, to make the sliding part 30 retract toward the inside of the processing cartridge 20C. Correspondingly, the processing cartridge may be aligned after being mounted at the right position.

The protection cover may further include a reset spring (not shown in the figures). When the processing cartridge is removed from the electronic imaging device, the rest spring may make the protection cover return to a position where the protection cover blocks the photosensitive element.

Figure 10:
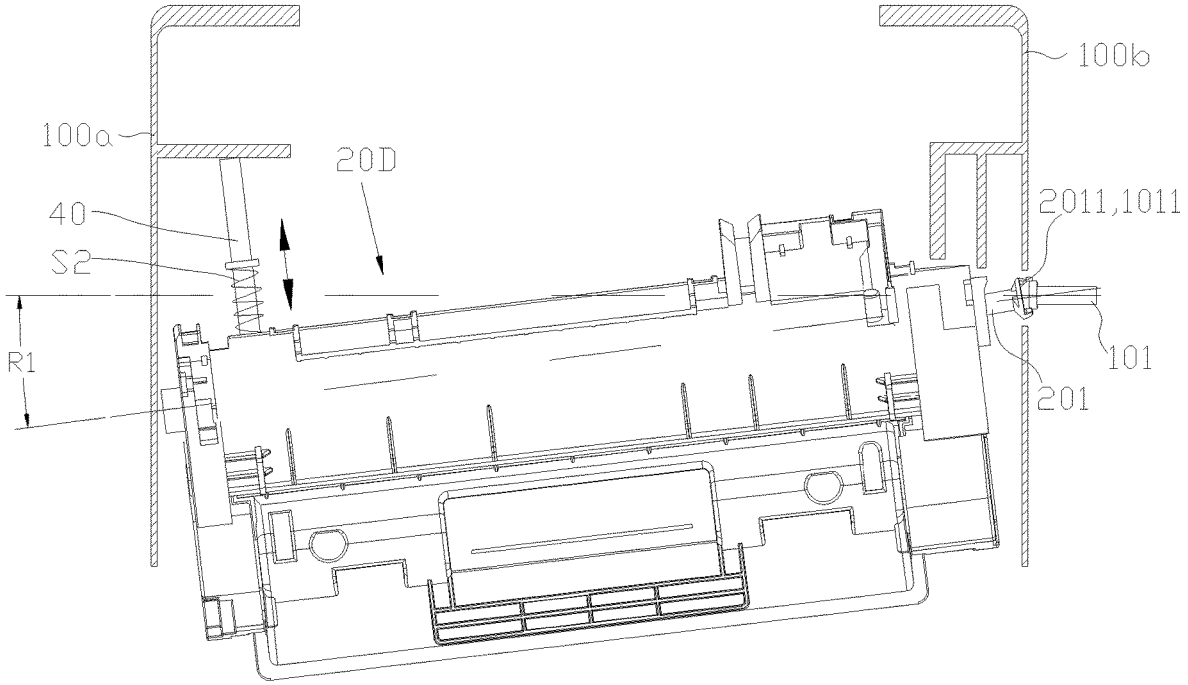
FIG. 10 illustrates a state of an exemplary processing cartridge being mounted into an imaging device provided by another embodiment of the present disclosure.

Another embodiment of the present disclosure also provides a processing cartridge 20D illustrated in FIG. 10. In comparison to the previous embodiments, in the processing cartridge 20D, the tilt assist part may be disposed at the back side of the processing cartridge, that is, a front of the mounting direction of the processing cartridge.

The tilt assist part of the processing cartridge 20D may include a sliding part 40, and an elastic part S2. The sliding part 40 may protrude outwards from the processing cartridge 20D. The elastic part S2 may be a spring. One end of the spring may be abutted against the sliding part 40, and another end of the spring may be abutted against the processing cartridge. The tilt assist part may be disposed near the second side of the processing cartridge 20D. When mounting the processing cartridge 20D into the electronic imaging device, an end of the sliding part 40 may firstly be abutted against the inside of the electronic imaging device. Because of mounting inertia, the first side of the processing cartridge 20D may continuously move toward the inside of the electronic imaging device, and the entire processing cartridge 20D may tilt relative the direction perpendicular to the mounting direction to form the angle R1. Since the entire processing cartridge 20D may tilt relative the direction perpendicular to the mounting direction, the force receiving element 201 may by pass the ends of the driving component 101 to avoid interference. When mounting the processing cartridge 20D, the sliding part 40 may retract into the inside of the processing cartridge 20D because the sliding part 40 may be affected by the inner sidewalls of the electronic imaging device. Correspondingly, the tilting angle R1 of the processing cartridge 20D may decrease gradually. When the processing cartridge is mounted at the right position, the longitudinal direction of the processing cartridge 20D may be roughly perpendicular to the mounting direction of the processing cartridge 20D, and the force receiving element 201 may be engaged with the driving component 101.

When removing the processing cartridge from the electronic imaging device, the force receiving element 201 may be engaged with the driving component 101. Because of the removing inertia, the processing cartridge may be firstly tilted, and the force receiving element 201 may be disengaged with the driving component 101, to allow the processing cartridge to be removed from the electronic imaging device. The sliding part 40 may protrude outwards from the processing cartridge because of the restoring force of the elastic part S2.

Figure 11:
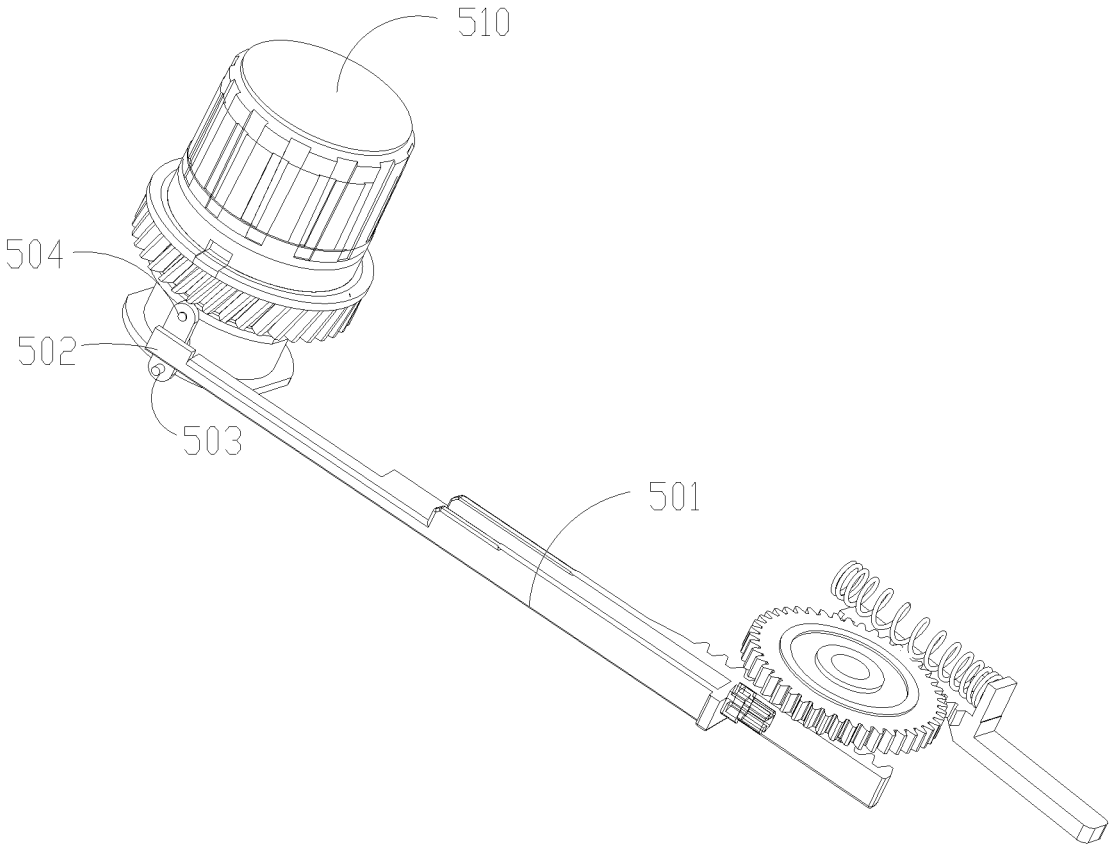
FIG. 11 illustrates a force receiving element and a push rod of an exemplary processing cartridge provided by another embodiment of the present disclosure.
Figure 12:
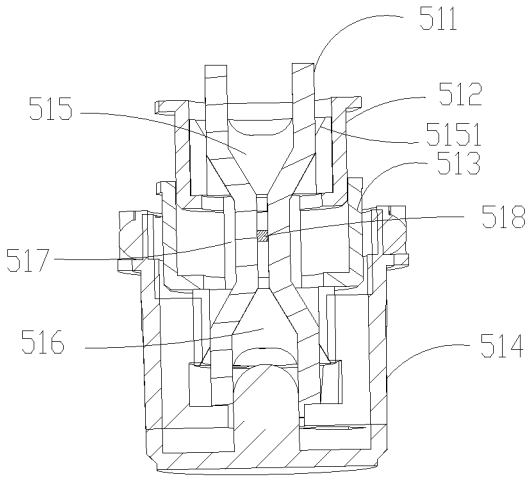
FIG. 12 illustrates a cross section of a force receiving element of an exemplary processing cartridge along a plane of an axis in a length direction of the force receiving element, provided by another embodiment of the present disclosure.

Another embodiment of the present disclosure provides a processing cartridge 20E illustrated in FIGS. 11-12. In the processing cartridge 20E, a hub 510 may be connected to a pushrod 501. The pushrod 501 may have any suitable structure. One end of the pushrod 501 may include a free end 502, and the free end 502 may be connected a first hinge 503 and a second hinge 504. The first hinge 503 may be connected to a first mobile part 512 and the second hinge 504 may be connected to a second mobile part 513. A position of a first mobile block 515 may be limited by the first mobile part 512, and the first mobile block 515 may rotate along a length direction of the hub 510 in the first mobile part 512. A position of a second mobile block 516 may be limited by the second mobile part 513, and the second mobile block 516 may rotate along the length direction of the hub 510 in the second mobile part 513. A connection rod 517 may be disposed between the first mobile block 515 and the second mobile block 516. Clamping rods 511 may be disposed in the first mobile block 515 and the second mobile block 516. A number of the clamping rods 511 may be at least two. An elastic part 518 may be disposed between the clamping rods 511. The first mobile block 515 may include a slope 5151. A connection part 514 may be connected to a rotating roller in the processing cartridge.

When the processing cartridge is not mounted into the main body of the electronic imaging device, that is, when the processing cartridge is at a first position, a distance from the first hinge 503 and the second hinge 504 to a connection point between the first mobile part 512 and the second mobile part 513 may be small. Correspondingly, a distance between the first mobile part 512 and the second mobile part 513, and a distance between the first mobile block 515 and the second mobile block 516 may be small. A distance between the clamping rods 511 may be small and the clamping rods 511 may be abutted against the slope 5151. Then the force cannot be transmitted from the electronic imaging device to the connection part 514.

When the processing cartridge is mounted into the main body of the electronic imaging device, that is, when the processing cartridge is at a second position, in comparison to the first position, the distance from the first hinge 503 and the second hinge 504 to a connection point between the first mobile part 512 and the second mobile part 513 may be large. Correspondingly, the distance between the first mobile part 512 and the second mobile part 513, and the distance between the first mobile block 515 and the second mobile block 516 may be large. Then the distance between the clamping rods 511 may be large and the clamping rods 511 may not be abutted against the slope 5151. Correspondingly, the clamping rods 511 may be engaged with the driving transmission component in the electronic imaging device, and also may be engaged with the connection part 514, to transmit the force from the electronic imaging device to the connection part 514.

When removing the processing cartridge from the main body of the electronic imaging device, because of the pushing rod 501, the first hinge 503 and the second hinge 504 may bring the first mobile part 512 and the second mobile part 513 close to each other. Because of the elastic part 518, the distance between the clamping rods 511 may increase and restore to the first position. Then the processing cartridge from the main body of the electronic imaging device.

In one embodiment, the slope 5151 may be disposed on the first mobile block 515. In another embodiment, the slope 5151 may be disposed on the second mobile block 516. A hole may be disposed at a place of the first mobile block 515 and/or the second mobile block 516 connect the connection rod 517. Correspondingly, the connection rod 517 can connect the first mobile block and the second mobile bock whenever the connection rod 517 is at the first position or at the second position.

Figure 13:
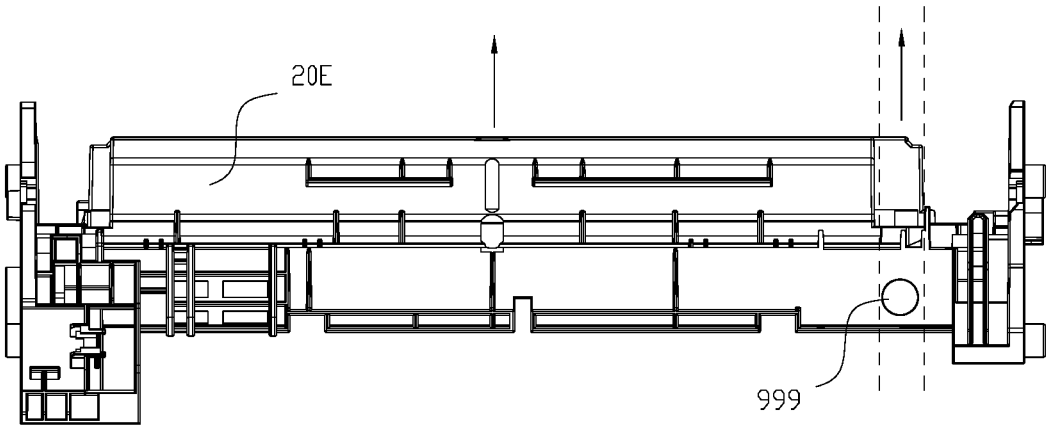
FIGS. 13-14 illustrate structures of protrusion structures of an exemplary processing cartridge provided by another embodiment of the present disclosure.
Figure 14:
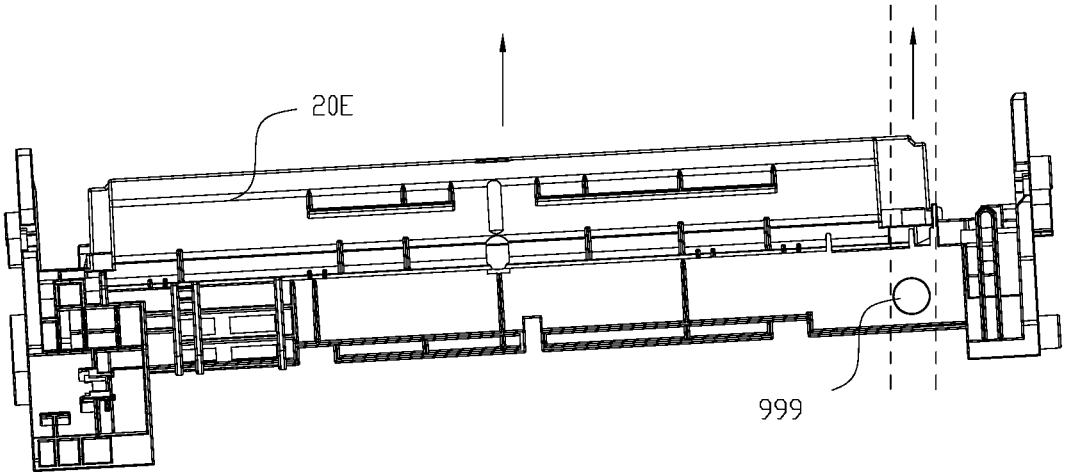

As illustrated in FIGS. 13-14, the processing cartridge may further include a protrusion 999. Preferably, the protrusion 999 may be a hemispherical protrusion. Correspondingly, the processing cartridge may be abutted against the structure inside the electronic imaging device whenever the processing cartridge is directly or obliquely mounted into the electronic imaging device.

Figure 15:
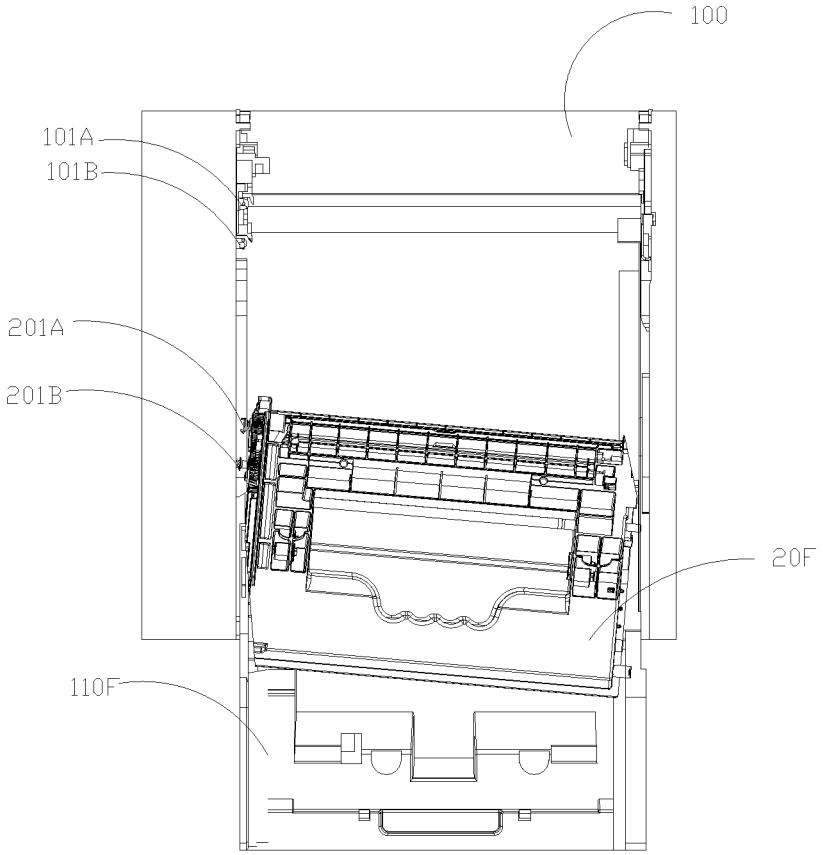
FIGS. 15-17 illustrate states of an exemplary processing cartridge corresponding to different steps of a process that mounting the processing cartridge into an imaging device provided by another embodiment of the present disclosure.
Figure 16:
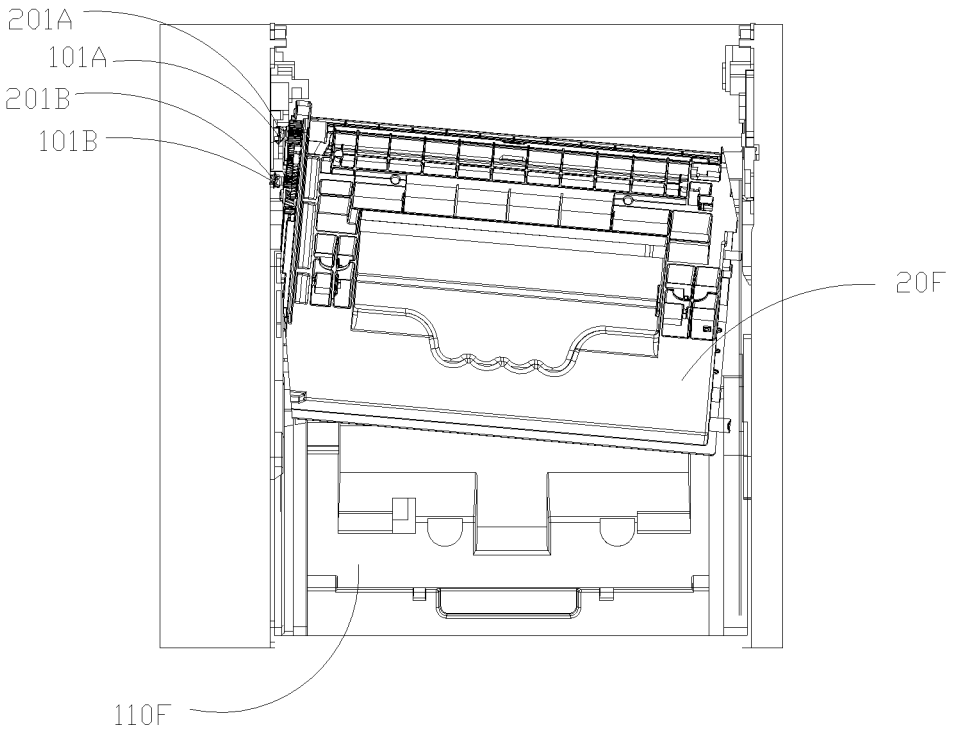
Figure 17:
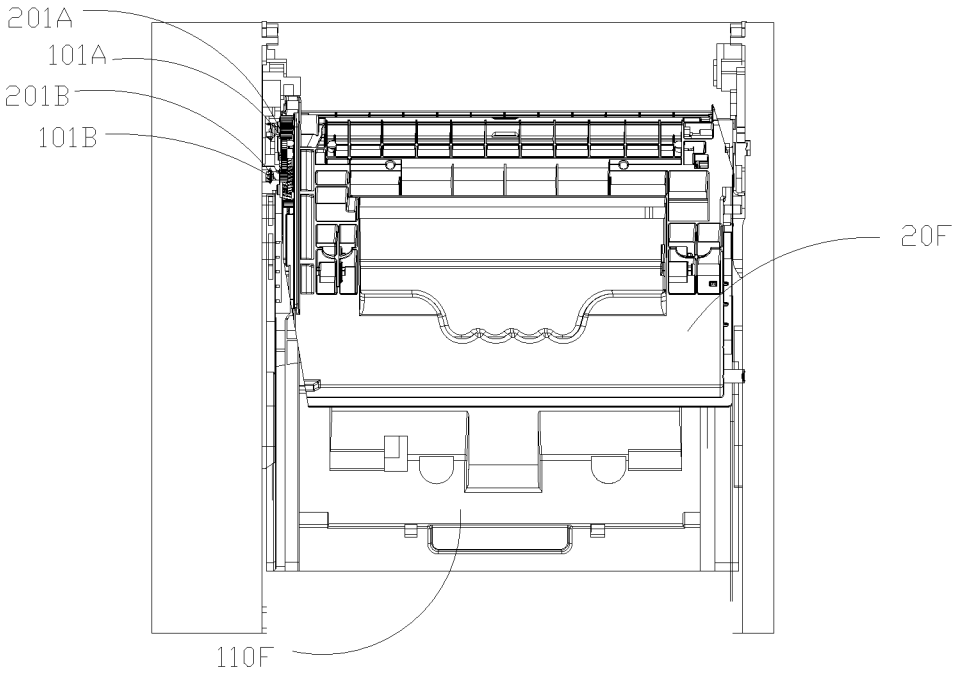

Another embodiment of the present disclosure provides another processing cartridge 20F illustrated in FIGS. 15-17. FIGS. 15-17 illustrate a process for mounting the processing cartridge 20F into the main body of the electronic imaging device 100. The main body of the electronic imaging device 100 may include a tray 110F, a first driving component 101A, and a second driving component 101B. The processing cartridge 20F may include a first force receiving element 201A and a second force receiving element 201B. The first driving component 101A may be engaged with the first force receiving element 201A, and the second driving component 101B may be engaged with the second force receiving element 201B. When mounting the processing cartridge 20F into the main body of the electronic imaging device 100, as illustrated in FIG. 16, the processing cartridge 20F may be placed on the tray 100F, and an angle between a length direction of the processing cartridge 20F and a moving direction of the tray 110F may not be a right angle. When the tray 100F gradually moves into the main body of the electronic imaging device 100, as illustrated in FIG. 17, one end of the processing cartridge 20F may be abutted against the main body of the electronic imaging device 100, and the length direction of the processing cartridge 20F and the moving direction of the tray 110F may become a right angle. Correspondingly, the first driving component 101A may be engaged with the first force receiving element 201A, and the second driving component 101B may be engaged with the second force receiving element 201B.

Figure 18:
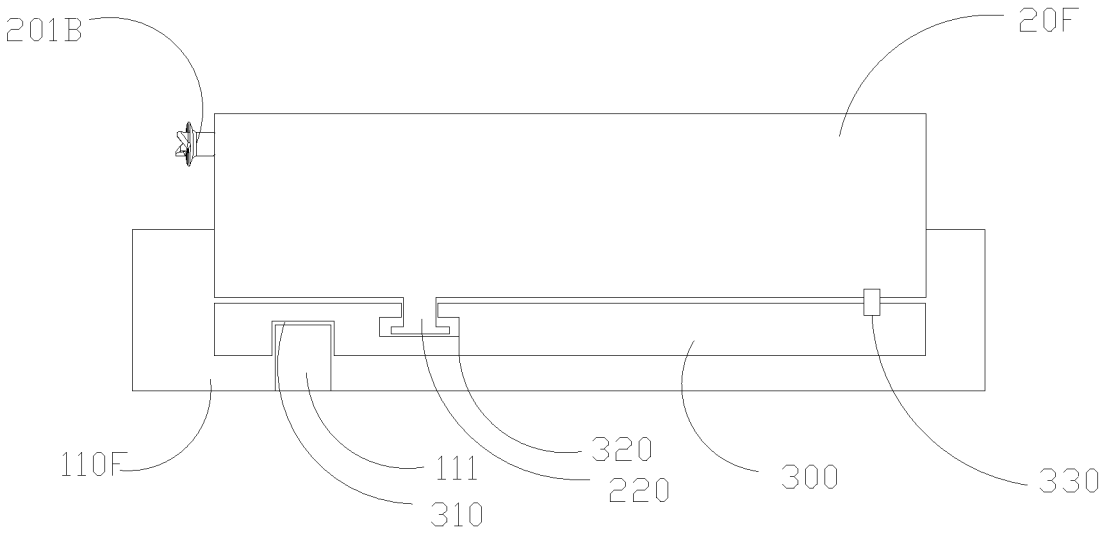
FIG. 18 illustrates a cross section of an exemplary processing cartridge along a line in a length direction of the processing cartridge, provided by another embodiment of the present disclosure.
Figure 19:
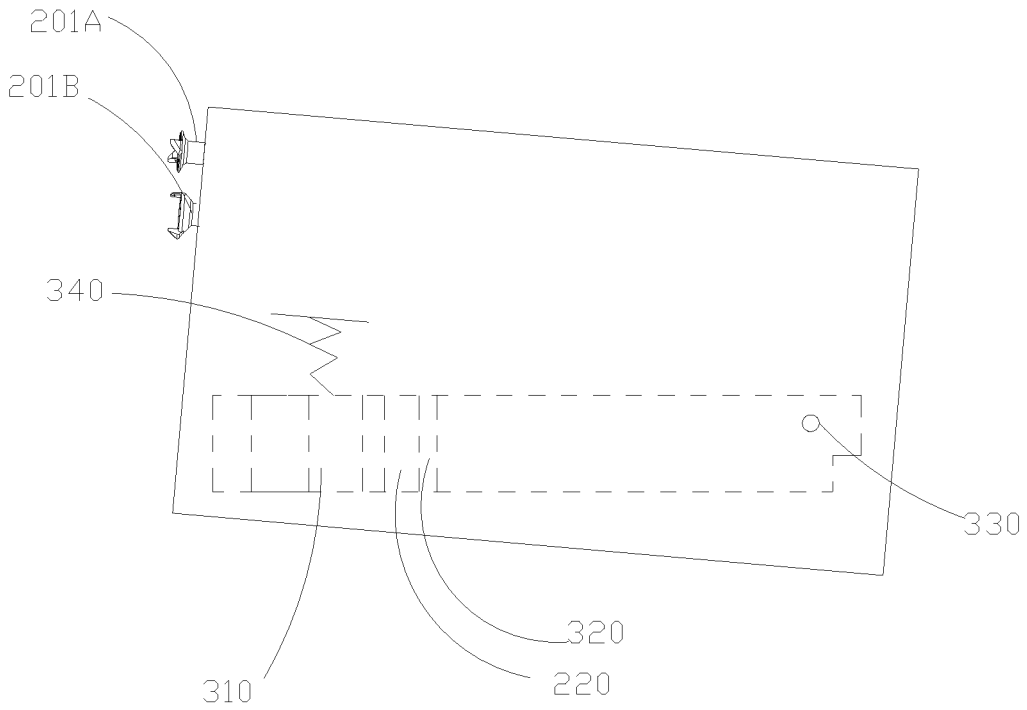
FIG. 19 illustrates a structure of an exemplary processing cartridge provided by another embodiment of the present disclosure.

To achieve above functions, a movable plate 300 may be connected to the processing cartridge 20F. As illustrated in FIGS. 18-19, the movable plate 300 may be connected to the processing cartridge 20F through a rotary shaft 330. The movable plate 300 may further include a first groove 310 and a second groove 320. A second protrusion 220 on the processing cartridge 20F may enter the second groove 320, and a first protrusion 111 on the tray 110F may enter the first groove 310. An elastic part 340 may be disposed between the processing cartridge 20F and the movable plate 300. One end of the elastic part 340 may be connected to the processing cartridge 20F and another end of the elastic part 340 may be connected to the movable plate 300.

When mounting the processing cartridge 20F and the movable plate 300 on the tray 110F, the movable plate 300 may be abutted against the tray 110F, and the length direction of the processing cartridge 20F may not be perpendicular to a moving direction of the movable plate 300 and the moving direction of the tray 110F, as illustrated in FIG. 16. When approaching a position in FIG. 17, the elastic part 340 may be compressed, to make the length direction of the processing cartridge 20F perpendicular to the moving direction of the movable plate 300 and the moving direction of the tray 110F.

Another embodiment of the present disclosure provides another processing cartridge 20G and a method to mount the processing cartridge 20G into the electronic imaging device obliquely with respect to a direction perpendicular to the mounting direction of the processing cartridge 20G.

Figure 20:
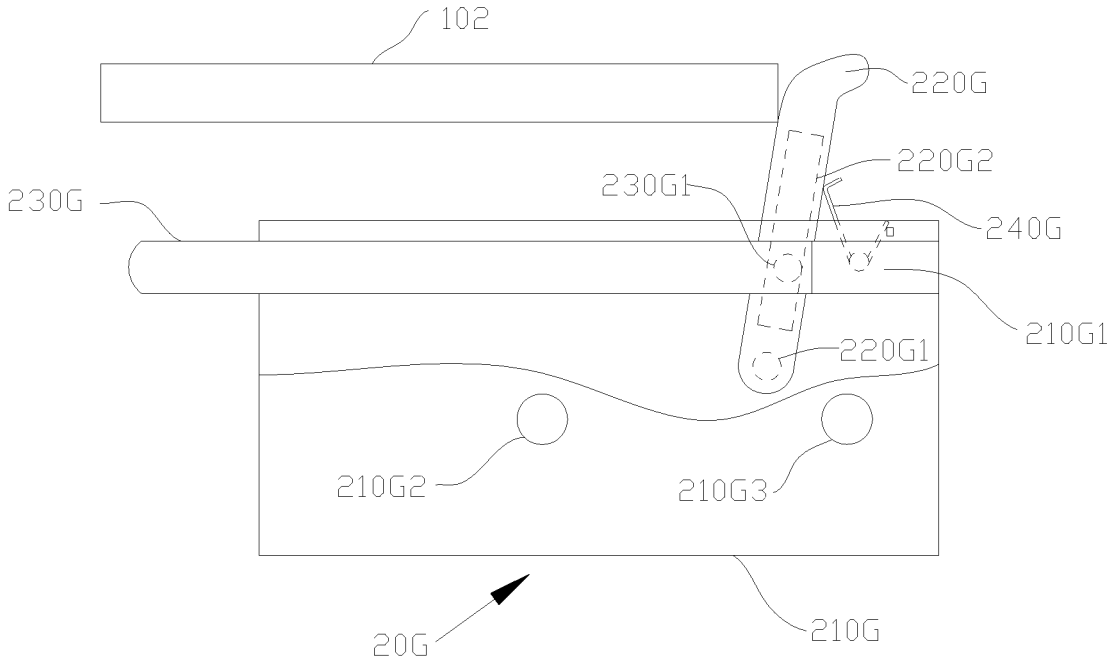
FIG. 20 illustrates a structure of an exemplary processing cartridge provided by another embodiment of the present disclosure.
Figure 21:
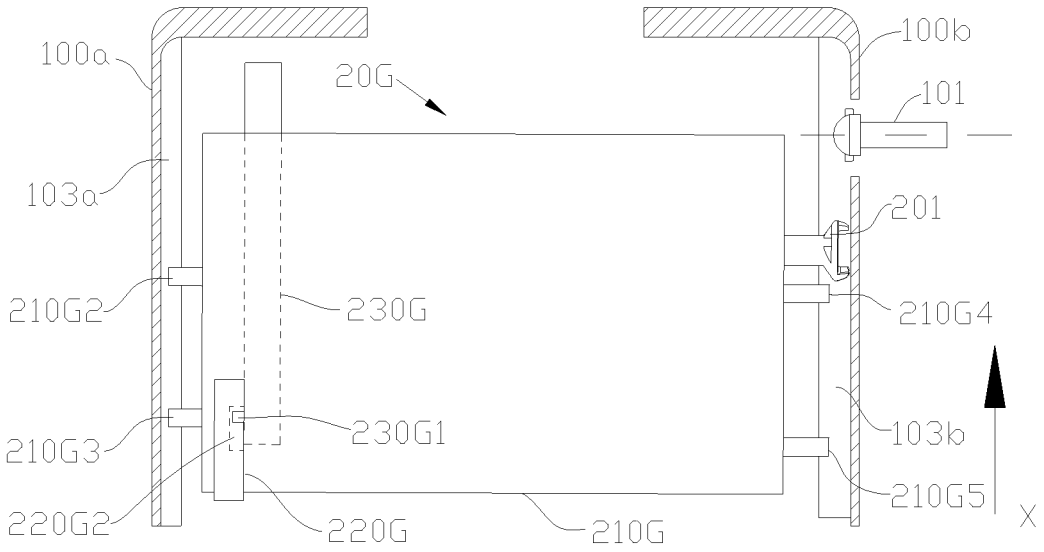
FIG. 21 illustrates a state of an exemplary processing cartridge being mounted into an imaging device provided by another embodiment of the present disclosure.

As illustrated in FIG. 20, the processing cartridge 20G may include a processing cartridge housing 210G. The processing cartridge housing 210G may include two sides along the longitudinal direction. The force receiving element 201 may be disposed at one of the two sides along the longitudinal direction, as illustrated in FIG. 21. FIG. 20 illustrates a view along a direction parallel to the longitudinal direction of the processing cartridge housing 210G.

A tilt assist mechanism may be disposed on the processing cartridge housing. The tilt assist mechanism may include a slide component 230G, and the slide component 230G may be slidable relative to a direction perpendicular to the longitudinal direction of the processing cartridge housing 210G. The processing cartridge housing 210G may further include a first sliding slot 210G1, and the slide component 230G may be disposed in the first sliding slot 210G1 and can slide along the first sliding slot 210G1. The slide component 230G may protrude out from the processing cartridge housing 210G.

The title assist mechanism may further include a swinging part 220G. The swinging part 220G may be disposed on the processing cartridge housing 210G and can swing with respect to the processing cartridge housing 210G. In one embodiment, the swinging part 220G may be hinged with the processing cartridge housing 210G through a swinging shaft 220G1.

When the swinging part 220G swings around the swinging shaft 220G1, the swinging part 220G may drive the slide component 230G to slide along the first sliding slot 210G1.

A second sliding slot 220G2 may further be disposed in the swinging part 220G along a length direction of a main body of the swinging part 220G. The slide component 230G may further include a protrusion 230G1. When the slide component 230G slides along the first sliding slot 220G1, the protrusion 230G1 may slide along the second sliding slot 220G2.

Since the swinging part 220G may protrude upwards from the processing cartridge housing 210G, when mounting the processing cartridge 20G into the electronic imaging device, the swinging part 220G may be abutted against the top part 102 of the electronic imaging device, and may be driven to swing.

Figure 22:
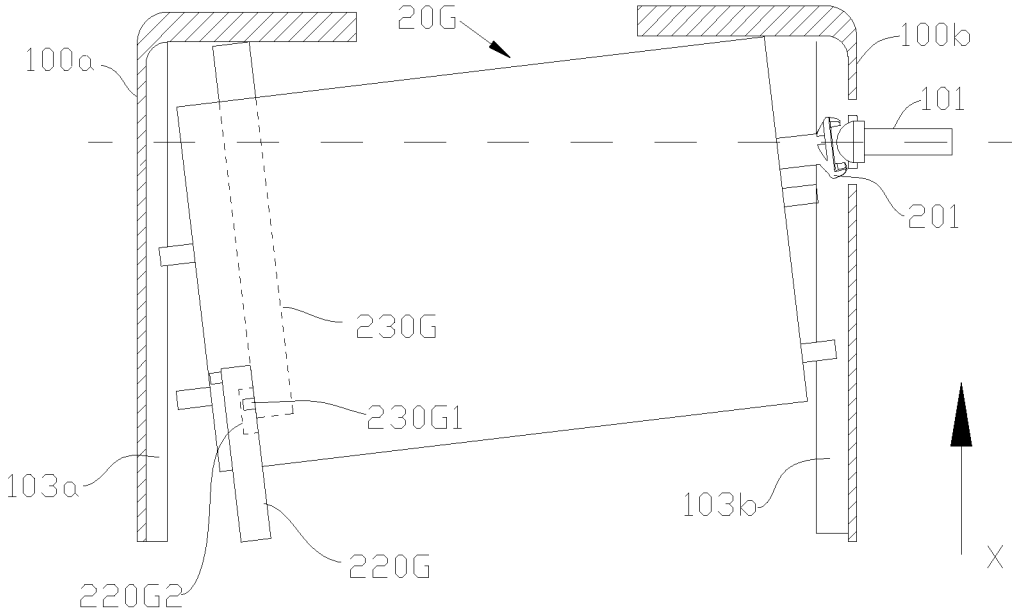
FIG. 22 illustrates a state of another exemplary processing cartridge being mounted into an imaging device provided by another embodiment of the present disclosure.
Figure 23:
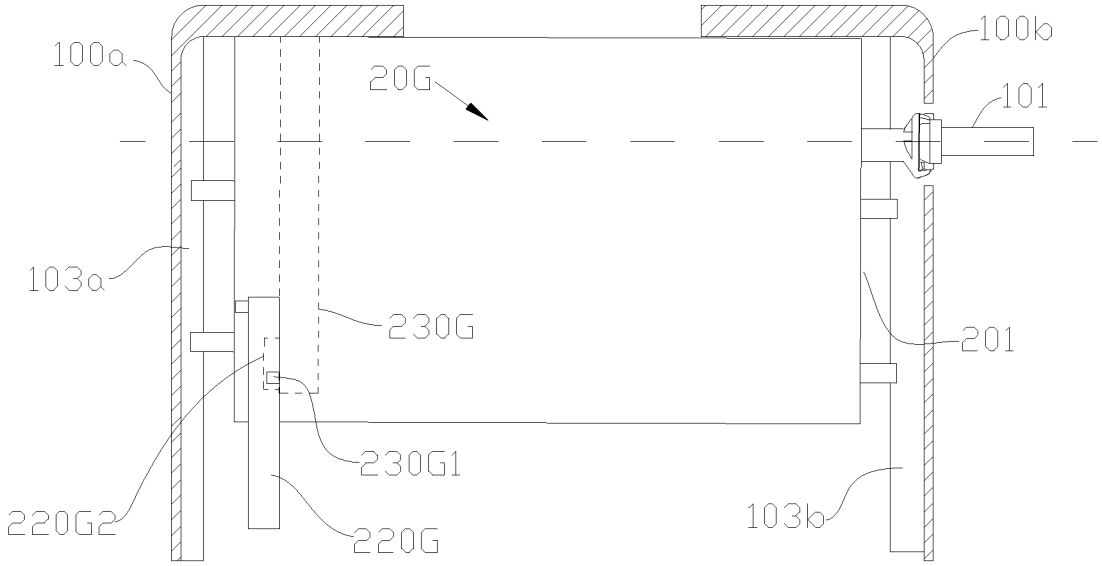
FIG. 23 illustrates a state of an exemplary processing cartridge mounted into an imaging device provided by another embodiment of the present disclosure.

FIGS. 21-23 illustrate a process for mounting the processing cartridge 20G into the electronic imaging device.

The electronic imaging device may include a first sidewall 100*a* and a second sidewall 100*b*. A processing cartridge mounting rail 103*a* may be disposed on the first sidewall 100*a*, and a processing cartridge mounting rail 103*b* may be disposed on the second sidewall 100*b*. Positioning protrusions 210G2, 210G3, 210G4, and 210G5 may protrude along two longitudinal ends of the processing cartridge housing 210G, for guiding the mounting of the processing cartridge 20G in cooperation with the mounting rails.

As illustrated in FIG. 23, when the processing cartridge 20G is continuously mounted along the electronic imaging device with the mounting direction along the X direction in the figures, an outwardly protruding portion of the sliding component 230G may abut against the inner wall of the electronic imaging device. An end of the processing cartridge 20G with the force receiving element 201 may continue to be mounted in the X direction under the inertia of the mounting force of the processing cartridge. Correspondingly, the processing cartridge 20G and the axis of the driving component 101 in the electronic imaging device may form an angle, and an end portion of the force receiving element 201 may be prevented from interfering with the driving component 101 when the processing cartridge 20G continue to be mounted. A part of the end portion of the force receiving element 201 may bypass the end portion of the driving component 101 and be engaged with the driving component 101. When the swinging part 220G abuts against the upper portion 103 of the electronic imaging device and is driven to swing downward, the sliding component 230G may be driven to retract along the inside of the processing cartridge housing 210G. When the processing cartridge is mounted into the right position, the longitudinal direction of the processing cartridge may be parallel to the rotation axis of the force receiving element 201, and the force receiving element 201 may be engaged with the driving component 101 to transmit force, as shown in FIG. 23.

The tilt assist component may further include a torsion spring component 240G. An end of the torsion spring component 240G may abut against the processing cartridge housing 210G and another end of the torsion spring component 240G may abut against the swinging component 220G. When the swinging component 220G swings downward driven by the electronic imaging device, the swinging component 220G swings downward to overcome elastic force of the torsion spring component 240G. When the processing cartridge is removed from the electronic imaging device, spring force of the torsion spring component 240G may drive the swinging component 220G to restore to its original position gradually, and may also drive the sliding component 230G extending to the outside of the processing cartridge housing 210G. The processing cartridge may be inclined with respect to the rotation axis of the driving component 101. The force receiving element 201 may be disengaged from the driving component 101.

Figure 24:
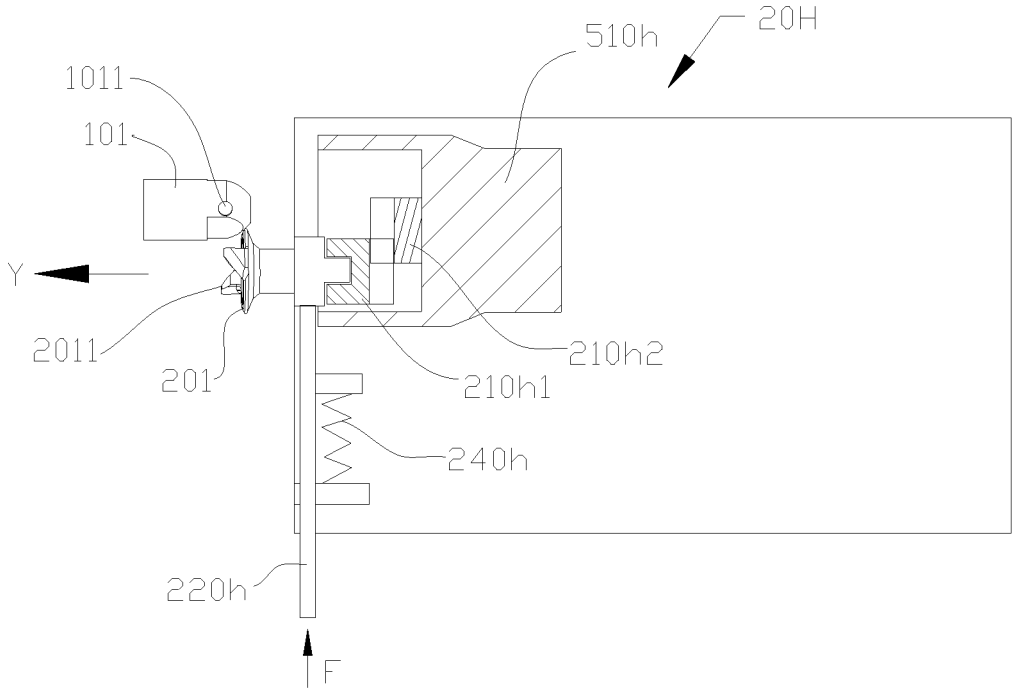
FIG. 24 illustrates a state of an exemplary processing cartridge being into an imaging device provided by another embodiment of the present disclosure.
Figure 25:
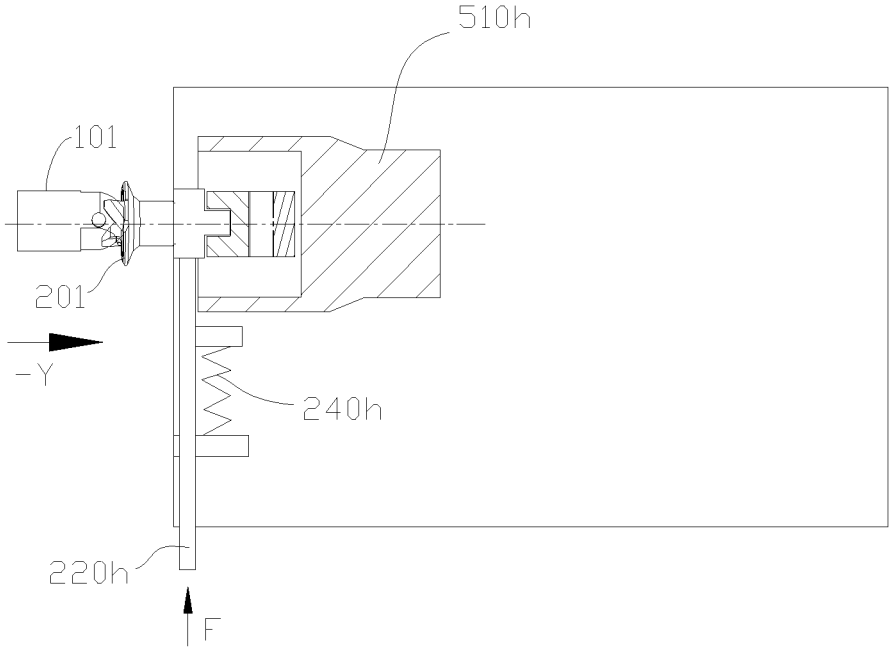
FIG. 25 illustrates a state of another exemplary processing cartridge being mounted into an imaging device provided by another embodiment of the present disclosure.

In another embodiment illustrated in FIGS. 24-25, the force receiving element 201 at the end of the processing cartridge may move in a direction perpendicular to the length direction of the processing cartridge or a direction perpendicular to the rotation axis of the force receiving element 201 (a radial direction). The force receiving element 201 may be disposed in a hub 510*h* disposed along the length direction of the processing cartridge and the hub 510*h* may be capable of rotating with respect to the processing cartridge housing. The force receiving element 201 may be connected to a cross-coupling structure. The cross-coupling structure may include an intermediate connection component 210*h*1 and an end connection part 210*h*2. An end of the intermediate connection component 210*h*1 may be slidably connected to the force receiving element 201, and another end of the intermediate connection component 210*h*1 may be slidably connected to the end connection part 210*h*2. The end connection part 201*h*2 may be connected to the hub 510*h*. A push rod 220*h* may be disposed at the end of the processing cartridge housing and may abut against the outside surface of the force receiving element 201. When the push rod 220*h* receives an external force, the push rod 220*h* may drive the force receiving element 201 to move along the radial direction of the force receiving element 201. The push rod 220*h* may also abut against an elastic component 240*h*. The elastic component 240*h* may be disposed between the push rod 220*h* and the processing cartridge housing, and may abut against both the push rod 220*h* and the processing cartridge housing.

After the processing cartridge is mounted in the electronic imaging device, the force receiving element 201 may be in contact with the end of the driving component 101 in the electronic imaging device, and the force receiving element 201 may move in the radial direction to avoid interference of the driving component 101. When the machine door is closed, the force receiving element 201 may further move in the radial direction driven by the push rod and the driving component may be driven to move in the Y direction as shown in the figure. When the force receiving element 201 moves radially to be coaxial with the hub 510, a part of the end portion of the force receiving element 201 may pass the end of the driving component 101, and at the same time, the driving component 101 may retract in a direction opposite to the Y direction to engage with the force receiving element 201 to transmit force. The force receiving element may be movable in the radial direction, to avoid a direct collision between the force receiving element and the driving component and to avoid a damage of the components because of the collision when the processing cartridge is mounted.

When the processing cartridge is removed from the electronic imaging device, the door of the electronic imaging device may be opened, and the push rod 220*h* may be ejected outside the processing cartridge driven by the spring force of the elastic component 240*h*, when applying a pulling force to the processing cartridge, the force receiving element may be still engaged with the driving component 101 of the electronic imaging device. Correspondingly, the force receiving element 201 may still move a certain distance in the radial direction opposite to a direction that the processing cartridge is removed. A forcibly removing of the processing cartridge from the electronic imaging device may be avoided to prevent friction damage of the components. Consequently, the processing cartridge may be removed from the electronic imaging device obliquely.

Further, a guide rail may be disposed to limit a moving path of the force receiving element 201. The guide rail may be fixed with respect to the processing cartridge housing. A position limit groove may be disposed and the force receiving element 201 may move along the position limit groove in a direction perpendicular to an axis of the hub 510*h*.

Another embodiment of the present disclosure provides an electronic imaging device. The electronic imaging device may include a driving component 101. When mounting the processing cartridge into the electronic imaging device, the force receiving element 201 at the end of the processing cartridge may be capable of engaging with the driving component 101 to transmit the force into the processing cartridge.

The driving component 101 in the electronic imaging device may be capable of freely rotating with respect to an axis of the driving component 101 when the electronic imaging device is not turn on, and may only transmit torque after the electronic imaging device is turn on.

Figure 26:
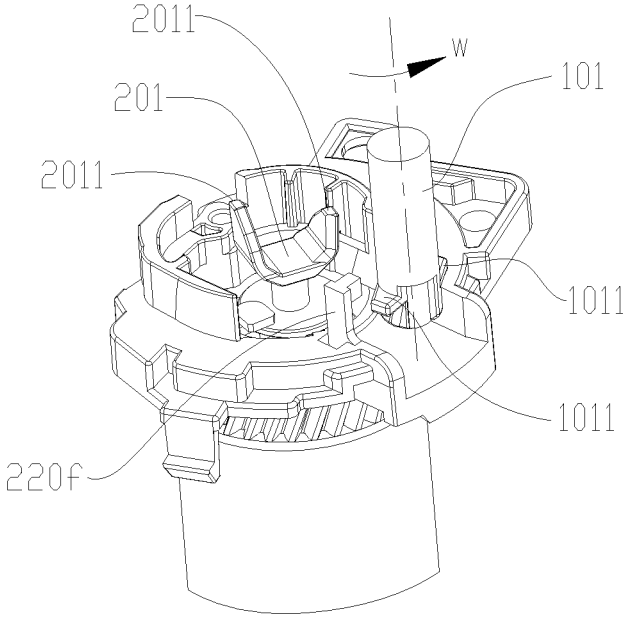
FIG. 26 illustrates a relative state of driving mechanisms when mounting an exemplary processing cartridge into an imaging device provided by another embodiment of the present disclosure.
Figure 27:
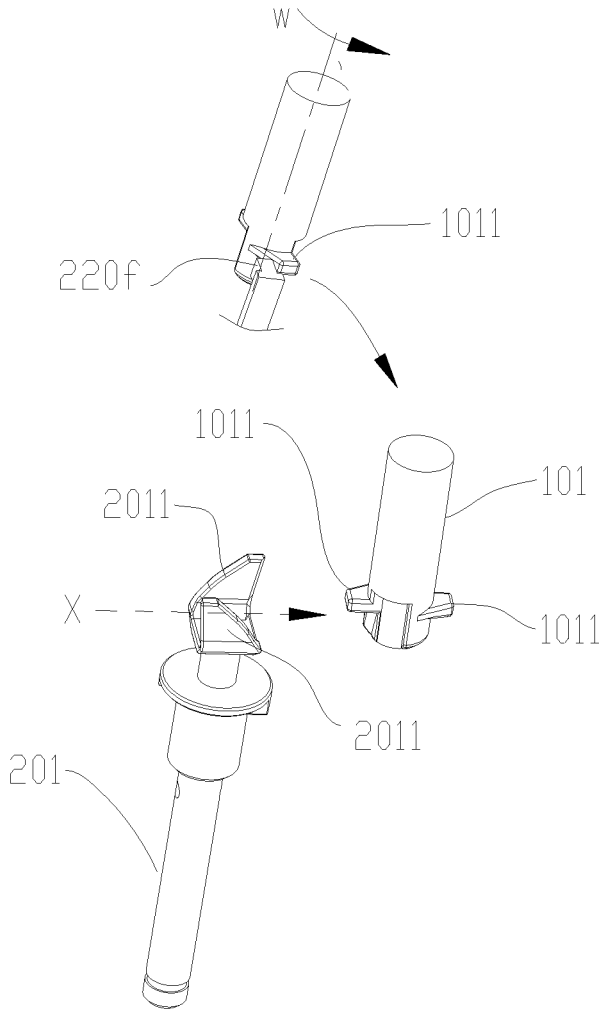
FIG. 27 illustrates a state of a driving component before engaging provided by another embodiment of the present disclosure.

The present embodiment also provides a mechanism for controlling the rotation of the driving component 101 of the electronic imaging device, as illustrated in FIGS. 26-27. When the processing cartridge is mounted to the electronic imaging device, the processing cartridge may be mounted into the electronic imaging device in a direction perpendicular to the length direction of the processing cartridge, that is, the electronic imaging device may enter the electronic imaging device in a direction perpendicular to the rotation axis of the force receiving element 201. The mechanism for controlling the rotation of the driving component 101 may include a protrusion 220*f* which is fixed with respect to the processing cartridge housing. When the processing cartridge is mounted in the electronic imaging device, the protrusion 220*f* may have a certain probability to contact force transmission portions 1011 of the driving component 101 of the electronic imaging device protruding in the radial direction of the driving component 101, to drive the driving component 101 to rotate when the processing cartridge is continuously mounted. As illustrated in FIG. 27, after the driving component 101 rotating in a w direction, a line connecting a pair of force transmission portions 1011 protruding in the radial direction of the driving component 101 may be not perpendicular to the mounting direction (the X direction shown in FIG. 27) of the processing cartridge. Preferably, the line connecting the pair of force transmission portions 1011 can be substantially parallel to the mounting direction of the processing cartridge or the line connecting a pair of force transmission portions 1011 and the mounting direction of the processing cartridge may form an angle less than 45 degree. When a connection line of a pair of force receiving parts 2011 protruding along the ends of the force receiving element 201 on the end of the processing cartridge is approximately perpendicular to the mounting direction of the processing cartridge, the force receiving element 201 and the driving component 101 may not interfere with each other, and the processing cartridge can be smoothly mounted into the right position.

The present embodiment also provides a structure that enables the force receiving element to rotate freely or partially with respect to a hub 510*f*, to ensure a smooth mounting of the processing cartridge.

Figure 28:
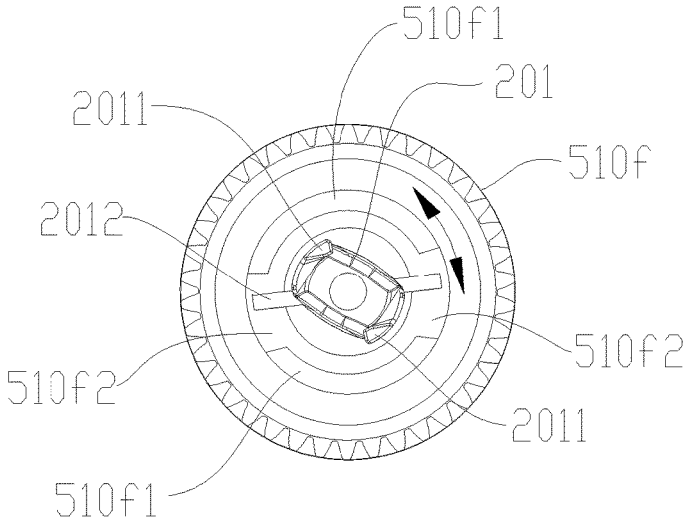
FIG. 28 illustrates a matching structure between a force receiving element and a flange provided by another embodiment of the present disclosure.

The force receiving element 201 may be disposed in a flange along a rotation axis of the hub 510*f*, and may be rotatable with respect to the flange. As illustrated in FIG. 28, at least a pair of hub force receiving parts 510*f*1 may be disposed in the flange along a circumferential direction of the flange. There may be a gap 510*f*2 between two hub force receiving parts 510*f*1. The force receiving element 201 may include a transmission component 212 along the radial direction of the force receiving element 210, and the force receiving element 210 may transmit the force to the flange through the transmission component 212.

When the processing cartridge is mounted into the electronic imaging device, a pair of force receiving parts of the force receiving element 201 may be in the mounting direction of the processing cartridge and may interfere with the driving component 101. The driving component 101 may drive the force receiving element 201 to rotate, to avoid the interference.

In another embodiment, the structure illustrated in FIG. 4 may also be used to make the force receiving element 201 rotate/reset through an elastic component 203 fixed with respect to the processing cartridge housing. That is, a line connecting the pair of force receiving parts of the force receiving element 201 may be kept approximately perpendicular to the mounting direction of the processing cartridge, to ensure the smoothly mounting of the processing cartridge.

There may be no displacement change of the force receiving element in the length direction of the processing cartridge.

When the processing cartridge is removed from the electronic imaging device, the processing cartridge can be taken out obliquely, that is, the length direction of the processing cartridge housing and the rotation axis of the driving component 101 may form an angle.

In another embodiment, the driving component 101 in the electronic imaging device may be configured to be able to rotate freely about its own rotation axis when printing is not performed. When the force receiving parts 2011 at the end of the force receiving element 201 and the transmission portions 1011 protruding from the driving component 101 touch each other, the driving component 101 may be able to rotate to avoid the interference position.

Figure 29:
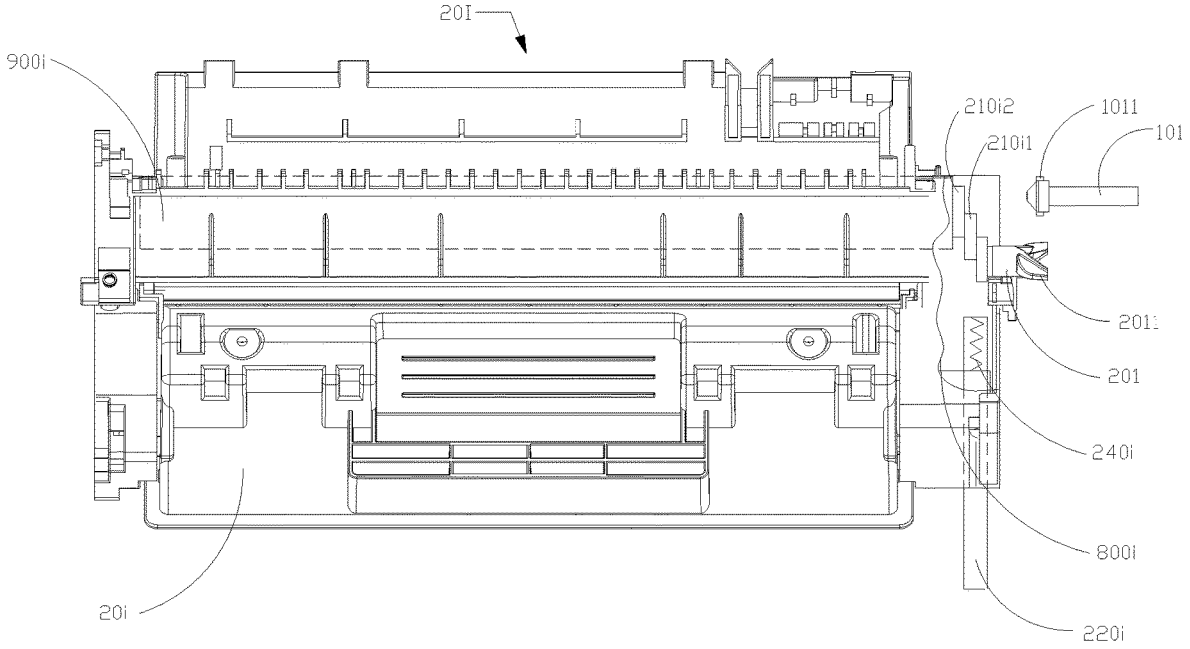
FIGS. 29-30 illustrate a structure of an exemplary processing cartridge provided by another embodiment of the present disclosure.
Figure 30:
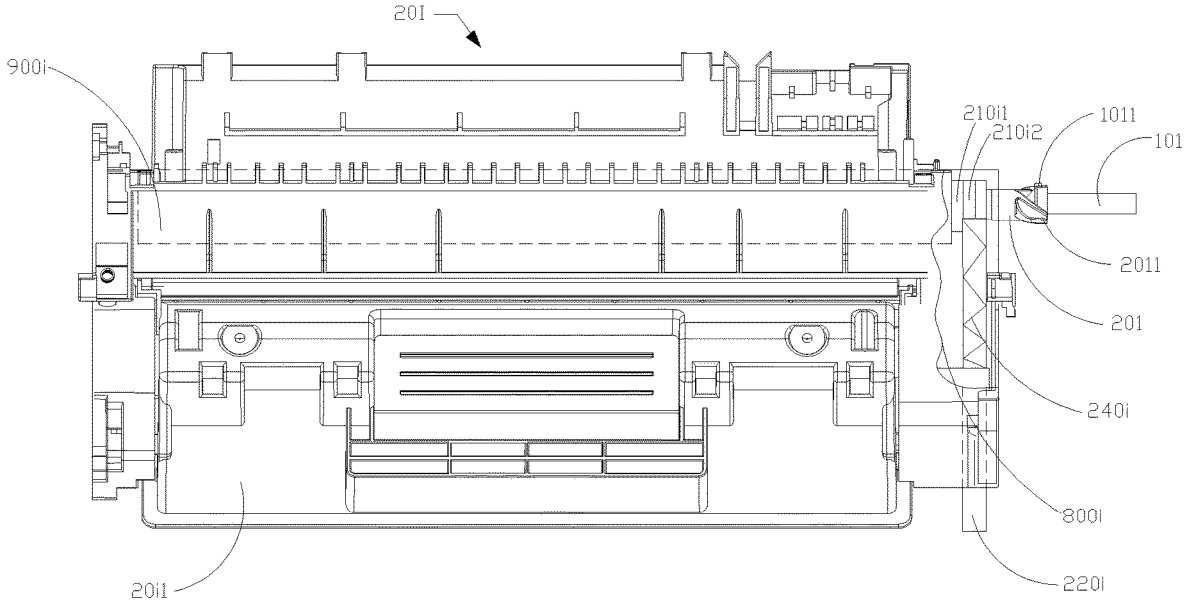

Another embodiment of the present disclosure provides another processing cartridge 20*i*. FIGS. 29-30 show structures of the processing cartridge 20*i* after removing a portion of the surface shell along a cutting line 800*i*. The force receiving element 201 at the ends of the processing cartridge 20*i* may be capable of moving in a direction perpendicular to the length direction of the processing cartridge or in a direction perpendicular to a rotation axis of the force receiving element 201 (that is, a radial direction of the rotation axis of the force receiving element). The force receiving element 201 may be connected to a cross-coupling structure including an intermediate connection component 210*i*1 and an end connection component 210*i*2. One end of the intermediate connection component 210*i*1 may be slidably connected to the force receiving element 201, and the other end may be slidably connected to the end connection component 210*i*2. The end connection component 210*i*2 may be fixed to one end of a photosensitive drum 900*i*. A push rod 220*i* may be provided at an end of the processing cartridge housing and the push rod 220*i* may abut against the outer surface of the force receiving element 201. When the push rod 220*i* receives an external force, the push rod 220*i* can drive the force receiving element 201 to move in its radial direction. The push rod 220*i* may be also abutted against an elastic element 240*i*. The elastic element 240*i* may be disposed between and abut against the processing cartridge and the push rod 220*i*.

Figure 31A:
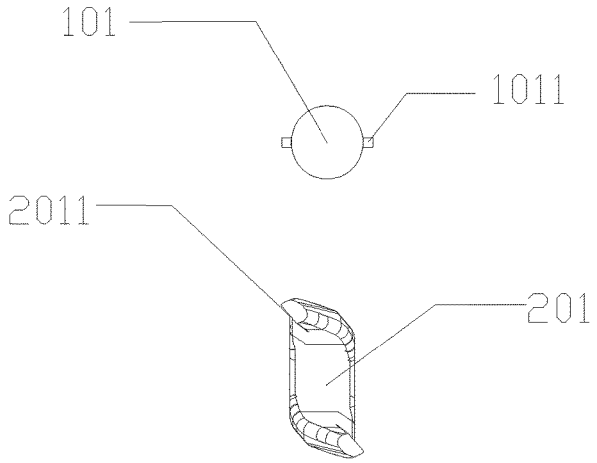
FIG. 31*a* and FIG. 31*b* illustrate a position of a dead point between a force receiving element and a transmission component provided by another embodiment of the present disclosure.
Figure 31B:
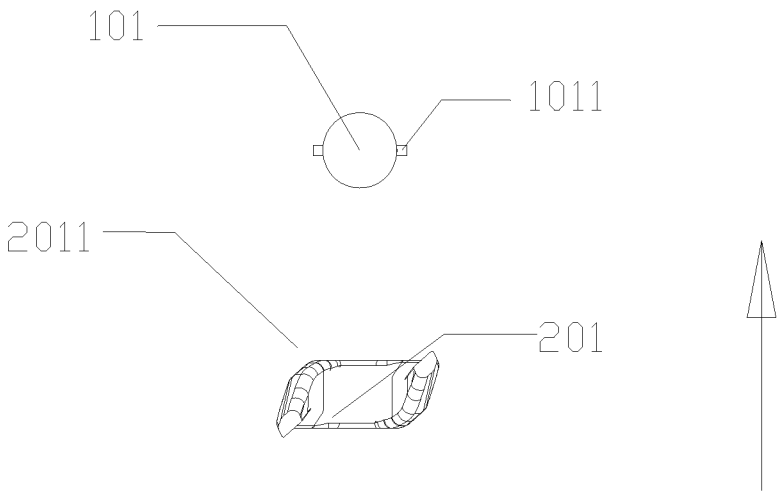
Figure 32A:
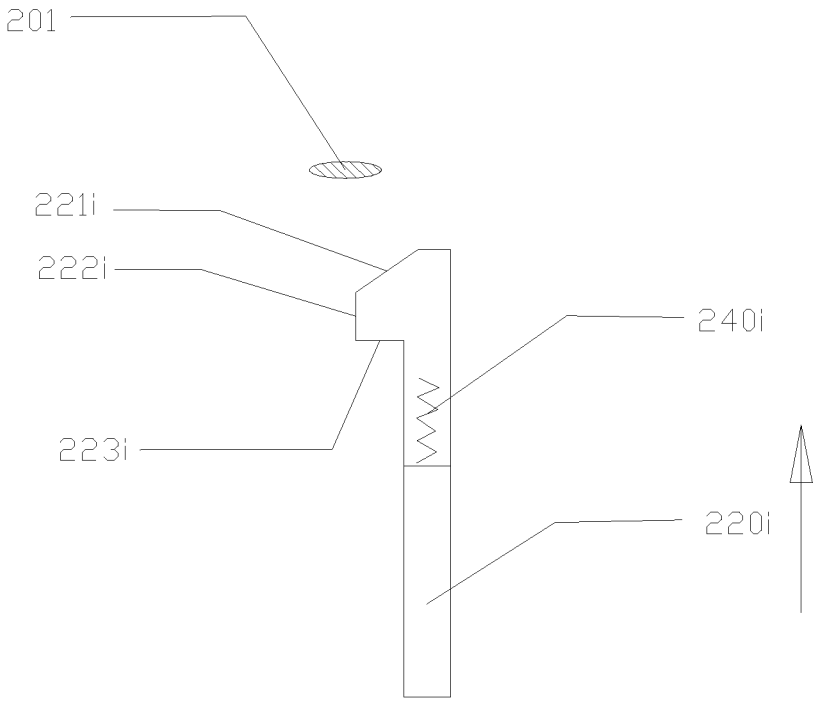
FIGS. 32*a*-32*c* illustrate a position relationship between a push rod and a force receiving element in an exemplary processing cartridge provided by another embodiment of the present disclosure.

Different from the previous embodiment, in this embodiment, the driving component 101 in the electronic imaging device cannot be retracted inward along the axial direction of the rotation axis of the driving component 101 in the electronic imaging device, so the force receiving element 201 may not be able to be engaged with the driving component 101 in the electronic imaging device. In FIG. 31*a* and FIG. 32*a*, free ends of the force receiving element 201 and the driving component 101 are shown from a plane perpendicular to the rotation axis of the force receiving element 201. In a case shown in FIG. 31*a*, the force receiving element 201 cannot be engaged with the driving component 101 in the electronic imaging device. In a case shown in FIG. 31*b*, the force receiving element 201 may also cannot be engaged with the driving component 101 provided in the electronic imaging device. Of course, these are only special cases. Since the force receiving element 201 can rotate along its rotation axis, when the force receiving element 201 is located at an angle different from that in FIG. 31*a*, the force receiving parts 2011 at the ends of the force receiving element 201 may abut against the driving component 101. Correspondingly, the force receiving element 201 may rotate by a short distance to be engaged with the driving component 101. In the case of FIG. 31*b*, since there is a certain amount of space when the force receiving element 201 is engaged with the driving component 101, as the driving component 101 rotates, the force transmitting portions 1011 protruding in the radial direction of the driving component 101 can also interfere with the force receiving parts 2011 at the end of the force receiving element 201 and rotate together. Finally, the force receiving element 201 may be also engaged with the driving component 101. Therefore, as long as the state in FIG. 31*a* is avoided, the force receiving element 201 can be engaged with the driving component 101.

Figure 32B:
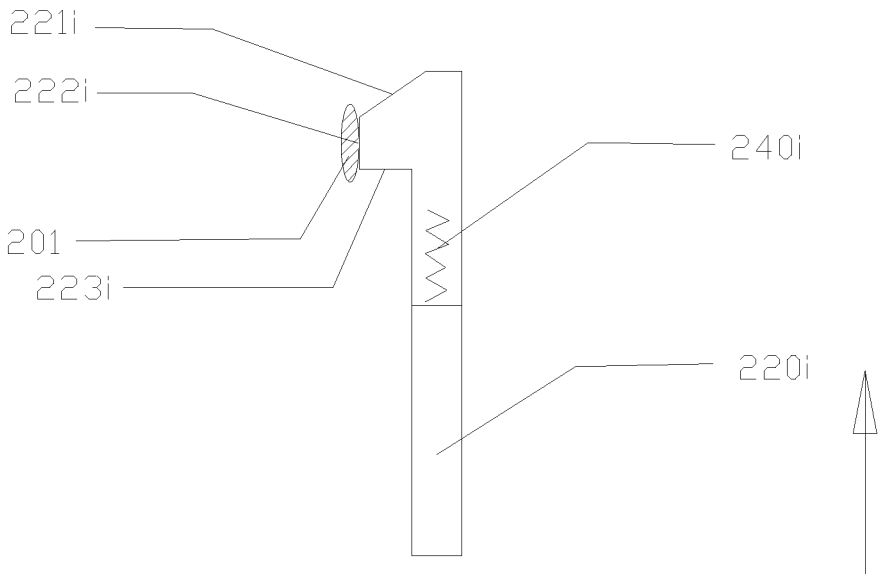
Figure 32C:
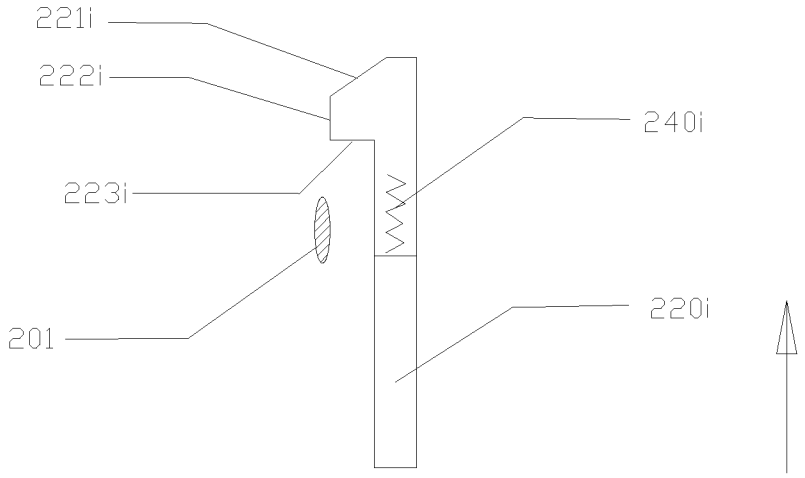

FIG. 32*a* to FIG. 32*c* are structural views of the push rod 220*i* and the force receiving element 201 cut along a plane perpendicular to the rotation axis of the force receiving element 201. The cross section of the force receiving element 201 may be oval. The push rod 220*i* may include an abutting surface 222*i* and a recess 223*i*. Preferably, the push rod 220*i* may further include a push surface 221*i*, and the push surface 221*i* may make the whole movement process smoother. As shown in FIG. 32*a*, at this time, the force receiving parts 2011 at the end of the force receiving element 201 may be same as that in FIG. 31*a*. That is, an elliptical long axis of rod part of the force receiving element 201 may be orthogonal to a line connecting the pair of the force receiving parts 2011 at the ends of the force receiving element 201. Of course, in another embodiment, it can also be said that the force receiving parts 2011 at the end of the force receiving element 201 may be located on a short axis of the ellipse of the rod portion of the force receiving element 201.

As shown in FIG. 32*a* to FIG. 32*c*, when the door of the electronic imaging device is closed, the door may push the push rod 220*i* toward the position of the force receiving element 201, and change the force receiving element 201 from a state in FIG. 31*a* to a state in FIG. 31*b*. That is, the force receiving element 201 may be in movement states shown in FIG. 32*a* and FIG. 32*b*. Next, the push rod 220*i* may continue to advance, so that the force receiving element 201 may be located in the recess 223*i* and it may not be interfered by the push rod 220*i* during the entire process of the force receiving element 201 engaging with the driving component 101 and transmitting. When the processing cartridge is taken out after the electronic imaging process is completed, as in the previous embodiment, the processing cartridge 20*i* may be taken out by using the oblique extraction method.

Figure 33:
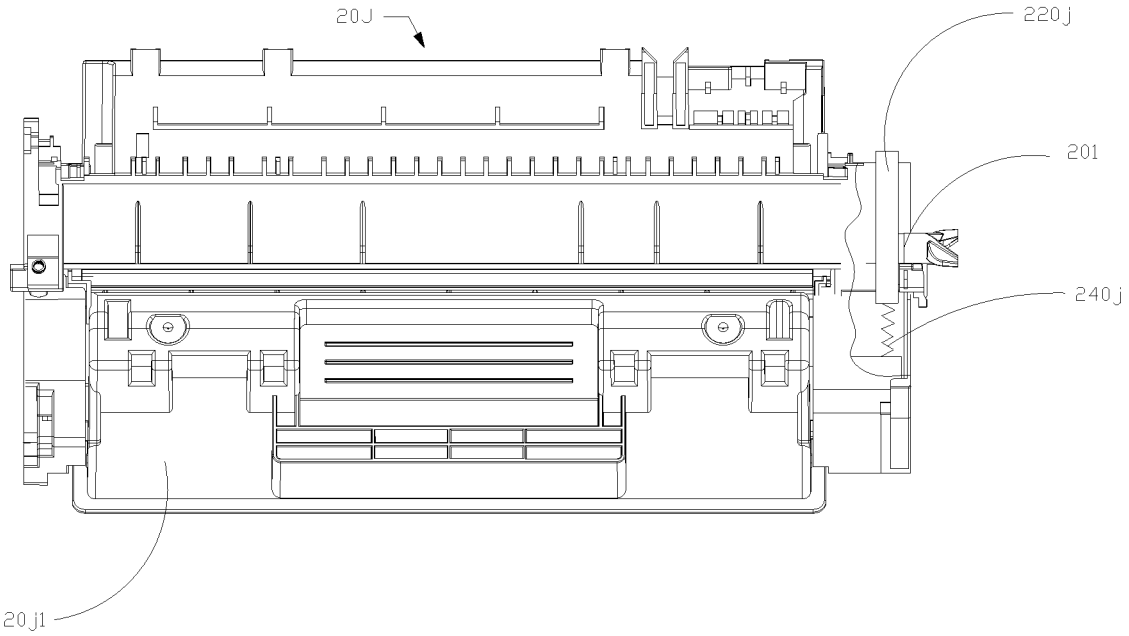
FIG. 33 illustrates a structure of another exemplary processing cartridge provided by another embodiment of the present disclosure.
Figure 34:
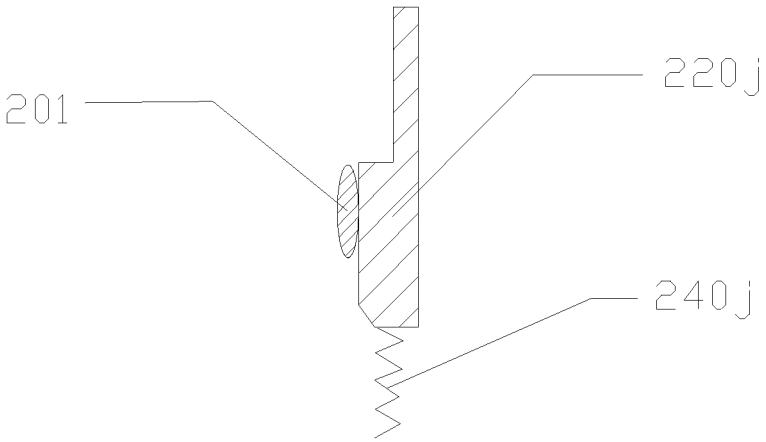
FIG. 34 illustrates a structure of a push rod in another exemplary processing cartridge provided by another embodiment of the present disclosure.

In another embodiment based on the present embodiment shown in FIGS. 33-34, in the processing cartridge 20*j*, a push rod 220*j* may be disposed on a side away from the door cover of the electronic imaging device, and may abut against the inner wall of the electronic imaging device. The force receiving element 201 and other parts on the processing cartridge may be basically unchanged, except that the positions of the push rod 220*j* and the elastic component 240*j* may be changed. The principle is the same as that of the first scheme of this embodiment.

Another embodiment of the present disclosure provides another processing cartridge. In the present embodiment, the force receiving element 201 may be capable of moving in a direction perpendicular to the length direction of the processing cartridge or in a direction perpendicular to a rotation axis of the force receiving element 201 (that is, a radial direction of the rotation axis of the force receiving element). The force receiving element 201 may be connected to a cross-coupling structure same as that in the previous embodiment.

In the previous embodiment, the state in which the force receiving element 201 and the driving component 101 cannot be engaged with each other and disposing rod of the force receiving element 201 with elliptical cross sections to resolve the above problem are described in detail, which is not repeated here. The present embodiment may eliminate the push rod structure to make the appearance of the processing cartridge more beautiful.

Figure 35A:
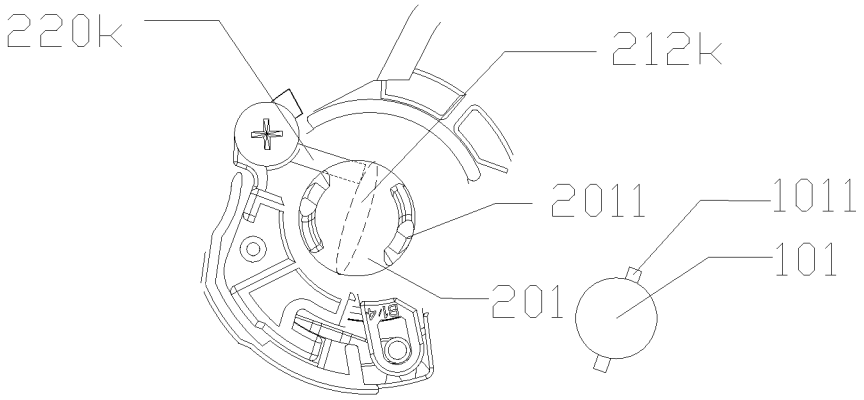
FIGS. 35*a*-35*d* illustrate a position relationship between a force receiving element and a transmission component in an exemplary processing cartridge provided by another embodiment of the present disclosure.
Figure 35B:
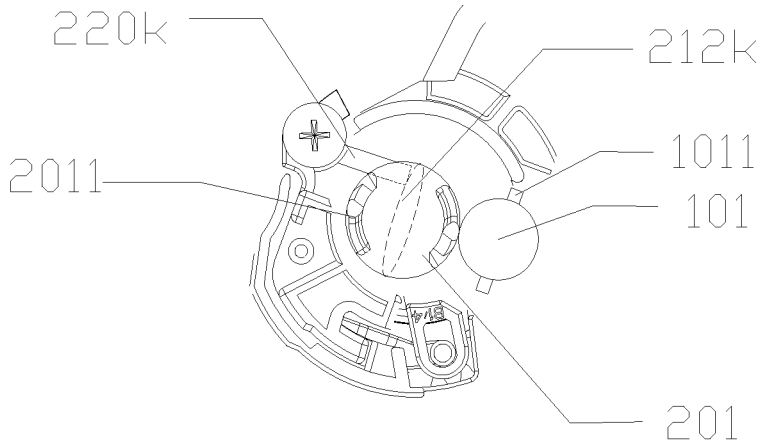
Figure 35C:
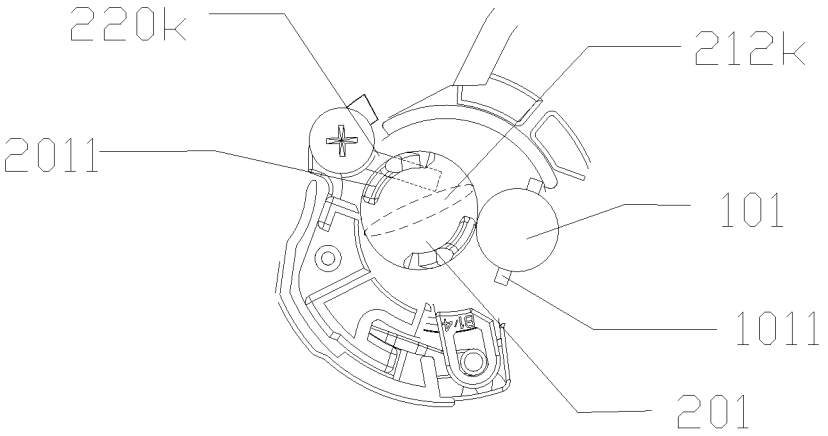
Figure 35D:
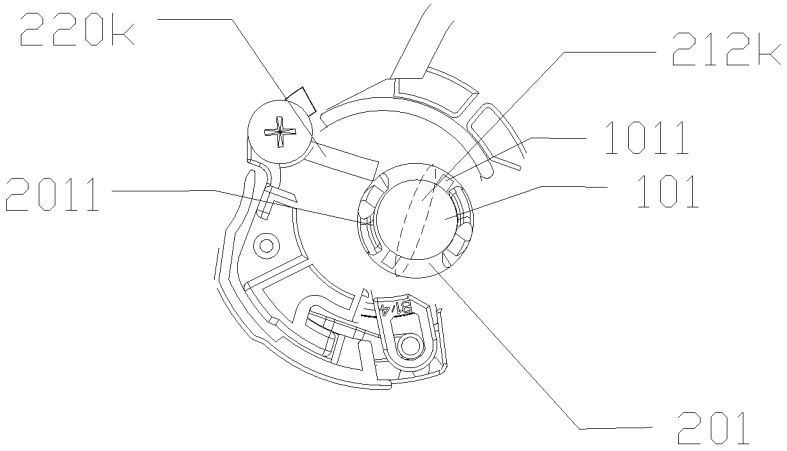

As shown in FIG. 35*a*, the driving component 101 may include force transmission portions 1011 protruding along the radial direction, and the processing cartridge may include a force receiving element 201 and a push rod 220*k*. The force receiving element 201 may include an end force receiving part 2011 and an elliptical support bar 212*k*. As shown in FIG. 35*b*, when mounting the processing cartridge, the driving component 101 and the force receiving element 201 may gradually approach and finally abut against each other. As shown in FIG. 35*c*, since the force receiving element 201 may be capable of translating a distance in a direction perpendicular to the rotation axis of the force receiving element 201, the force receiving element 201 may continue to move by a small distance in a direction opposite to the mounting direction of the processing cartridge under the abutment of the driving component 101. At this time, the push rod 220*k* may abut against the elliptical support rod 212*k* and may drive the force receiving element 201 to rotate, to avoid the dead point position described in FIG. 31*a* in the previous embodiment. At this time, the force receiving element 201 may be engaged directly with the driving component 101 or may be engaged with the driving component 101 as the driving component 101 rotates. As shown in FIG. 35*d*, when the processing cartridge works normally in the electronic imaging device, the combination composed of the force receiving element 201 and the driving component 101 may not interfere with the push rod 220*k* and may not affect normal electronic imaging.

Preferably, an elastic push component may be further provided on the cross-coupling, for pushing the force receiving element 201 to shift toward the front of the processing cartridge mounting direction, so that the force receiving element 201 and the driving component 101 may be more easily engaged.

Figure 36:
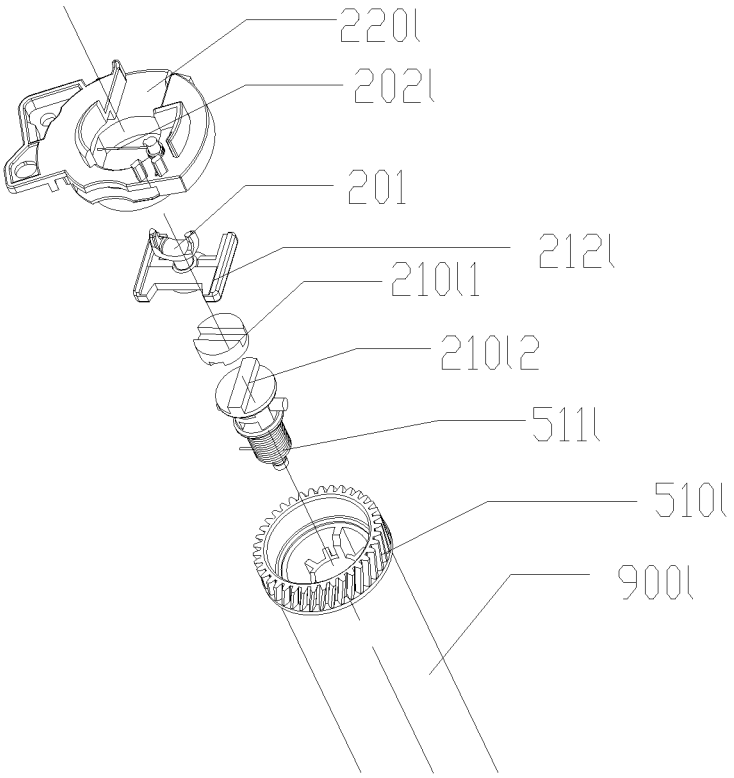
FIG. 36 illustrates an exploded view of parts receiving force in an exemplary processing cartridge provided by another embodiment of the present disclosure.

Another embodiment of the present disclosure provides another processing cartridge. FIG. 36 shows an exploded view of all relevant parts in the processing cartridge receiving force when the driving component on the electronic imaging device transmits force to the processing cartridge. A first elastic component 202*l* may be disposed on the end cover 220*l*; the force receiving element 201 may be connected to a limit block 212*l*, and the limit block 212*l* may contact the end cover 220*l* and be restrained by the end cover 220*l*, so that the limit block 212*l* and the force receiving element 201 can only move relative to the end cover 220*l* in one direction perpendicular to the rotation axis of the force receiving element 201 (possibly be achieved by setting a positioning column or a groove). The force receiving element 201 may be capable of rotating along the rotation axis of the force receiving element 201 relative to the limit block 212*l*. Three parts including the intermediate connection component 210/1, the end connection component 210/2, and the force receiving element 201 may be similar to those in the previous embodiments, and may together form a cross-coupling structure. The end connection component 210/2 may be disposed in the hub 510*l*. A second elastic component 511*l* may be also provided between the hub 510*l* and the end connection component 210/2. Preferably, the hub may be connected to one end of the photosensitive drum 900*l*.

Figure 37:
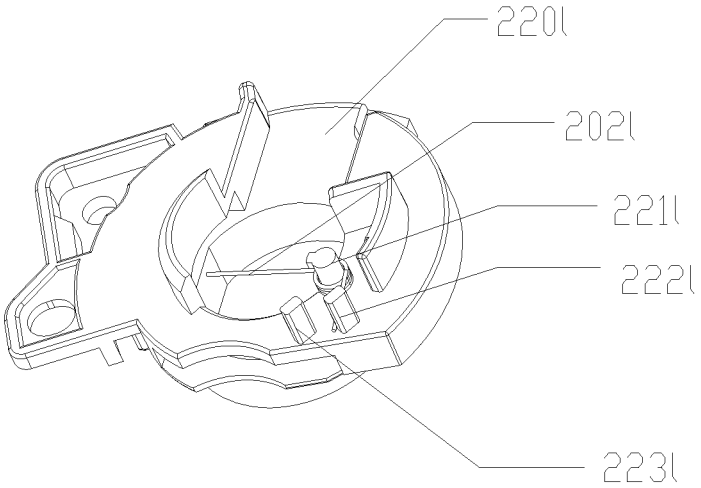
FIG. 37 illustrates an end cover provided by another embodiment of the present disclosure.

Preferably, the first elastic component 202*l* may be a torsion spring. Of course, the second elastic component may be configured as a spring or a tension spring as described in the previous embodiments. As shown in FIG. 37, the first elastic component 202*l* may be provided as a torsion spring fixed on a fixing post 221*l*, and one corner of the torsion spring may abut against a first abutment post 222*l*, and another corner of the torsion spring may abut against the force receiving element 201. Preferably, a second abutting post 223*l* may be further provided to prevent the torsion spring from coming out. The fixing post 221*l*, the first contact post 222*l*, and the second contact post 223*l* may be all disposed on the end cover 220*l*.

Figure 38:
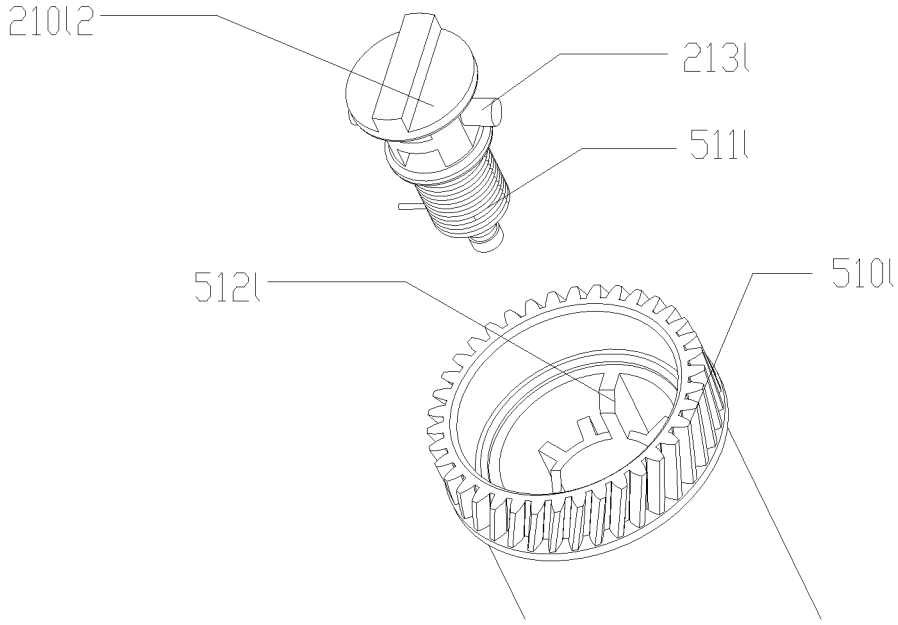
FIG. 38 illustrates an end connection component and a hub provided by another embodiment of the present disclosure.
Figure 39:
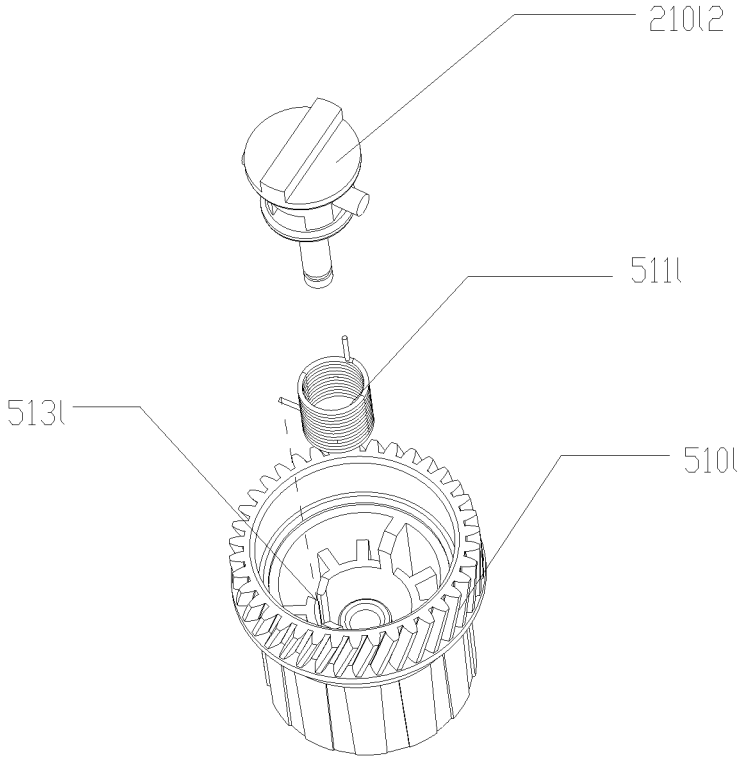
FIG. 39 and FIG. 40 illustrate a connection relationship between a second elastic component, a hub, and an end connection component provided by another embodiment of the present disclosure.
Figure 40:
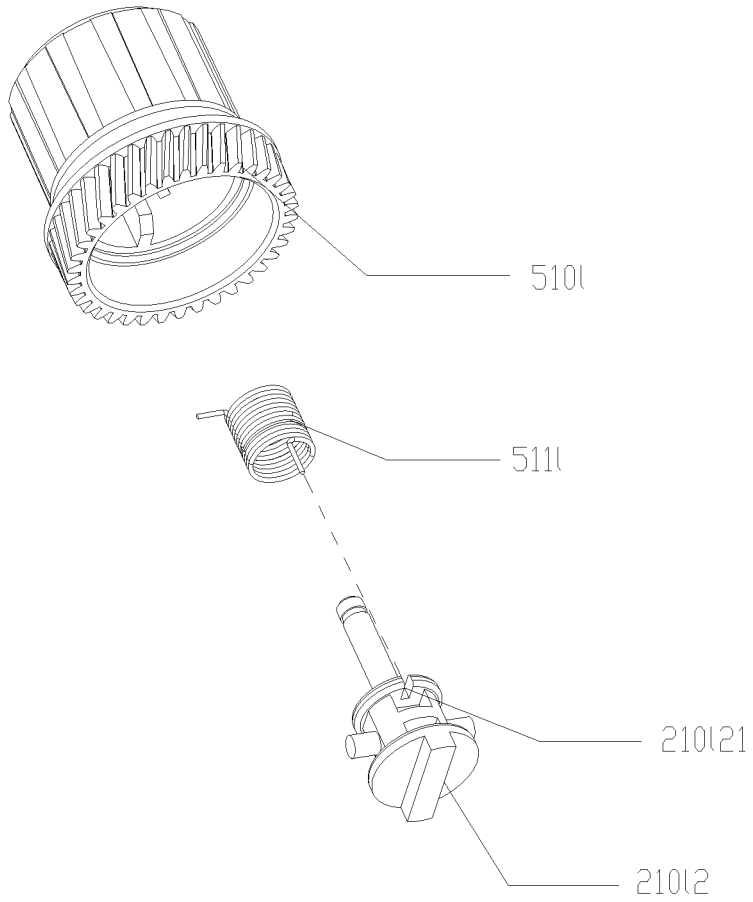
Figure 41:
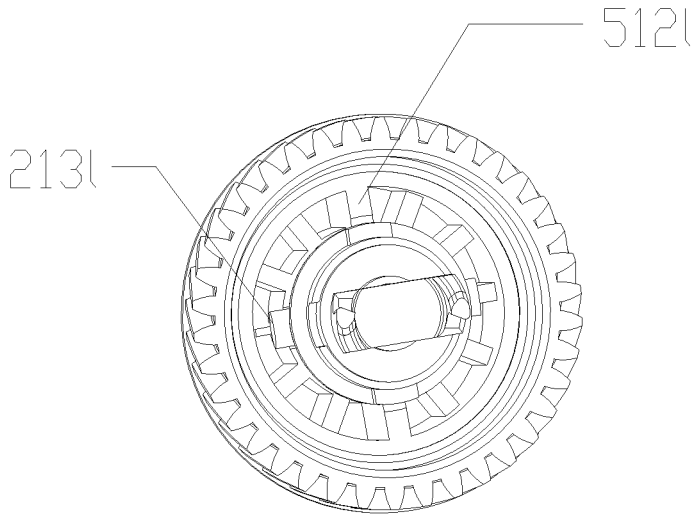
FIG. 41 illustrates a position relationship between protruding poles and protruding blocks provided by another embodiment of the present disclosure.

As shown in FIG. 38, protruding posts 213*l* may be also provided on the end connection component 210/2, and force receiving parts (that is, protruding blocks 512*l*) may be also provided on the hub 510*l*. The protruding posts 213*l* may abut against the protruding blocks 512*l* to transmit force. Preferably, there may include two protruding posts 213*l* and two protruding blocks 512*l*. The two protruding posts 213*l* may be symmetrical with respect to the rotation axis of the end connection component 210/2, and the two protruding blocks 512*l* may be symmetrical along the rotation axis of the hub 510*l*. A second elastic component 511*l* may be also provided between the end connection component 210/2 and the hub 510*l*. The second elastic component 511*l* may make the protruding post 213*l* and the protruding blocks 512*l* not contact each other when the end connection component 210/2 and the hub 510*l* are not subjected to external force. Preferably, the second elastic component 511*l* may be a torsion spring. As shown in FIGS. 39 and 40, in the second elastic component 511*l* provided as a torsion spring, one leg of the torsion spring may be inserted into the groove 513*l* on the hub 510*l*, and another leg may be inserted into the groove on the end connection component 210/2. Preferably, the second elastic component 511*l* may make the angle between the protruding posts 213*l* and the protruding blocks 512*l* be 90 degrees when the end connection component 210/2 and the hub 510*l* are not subjected to external force, as shown in FIG. 41. Such a design may make the force receiving element 201 have a certain amount of space before driving the hub, whether it rotates clockwise or counterclockwise. Therefore, the force receiving element 201 may be more flexible.

Figure 42:
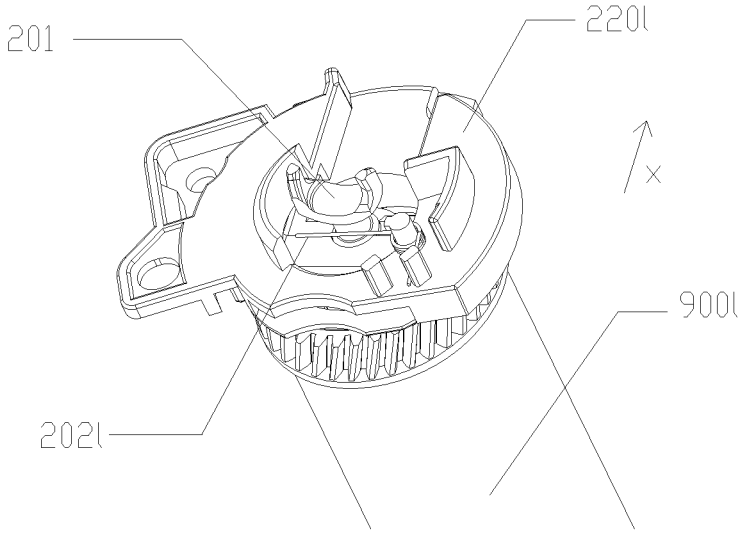
FIG. 42 illustrates a three-dimensional view of parts receiving force in an exemplary processing cartridge provided by another embodiment of the present disclosure.

When the assembly is completed, the end cover 220*l* and the hub 510*l* may constrain the other components inside the hub, and prevent the force receiving element 201 from moving axially along the rotation axis of the force receiving element 201. As shown in FIG. 42, when the processing cartridge is mounted into the electronic imaging device, all relevant parts of the processing cartridge receiving force may move in the X direction, and the force receiving element 201 may be engaged with the driving component. However, similar to the description in the previous embodiments in FIG. 31*a* and FIG. 31*b*, the force receiving element 201 may be directly engaged with the driving component, may smoothly engage with the driving component when it is rotated slightly by a small angle, or the force receiving element 201 and the driving component may enter a dead point and cannot be engaged with each other at all. When the force receiving element 201 is directly engaged with the driving component or rotates with a smaller angle to engage with the driving component, the driving component may rotate directly, and the rotational driving force may be transmitted to the hub 510*l* through the engage. However, when the force receiving element 201 and the driving component cannot be engaged with each other at all, in this embodiment, the force receiving element 201 and the limit block 212*l* can move by a distance in the X direction opposite to the end cover 220*l*. At this time, the first elastic component 202*l* may urge the force receiving element 201 toward the position of the driving component, so that the force receiving element 201 may always abut against the driving component. When the driving component rotates later, the force receiving element 201 may be engaged with the driving component. With this design, during the process of mounting the processing cartridge, a problem that the processing cartridge cannot be installed in the electronic imaging device due to the dead point of the force receiving element 201 and the driving component may be avoided. A deadlocked problem that the electronic imaging device cannot close the door, the electronic imaging device cannot pass the processing cartridge mounting check and then the drive component cannot rotate, may also be avoided.

Figure 43:
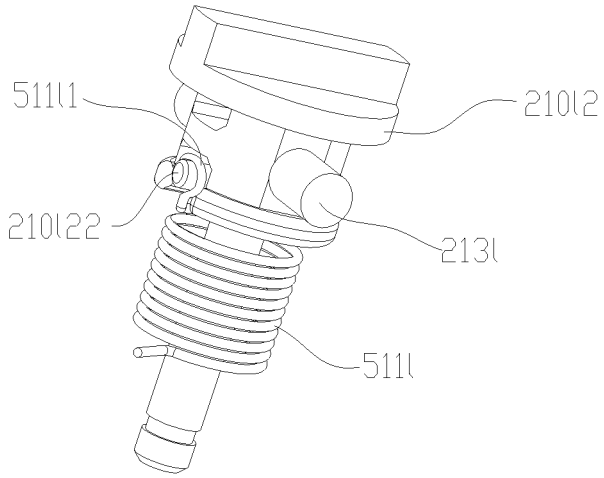
FIG. 43 illustrates a structure of another exemplary processing cartridge provided by another embodiment of the present disclosure.

In other embodiments, the above design may be modified. As illustrated in FIG. 43, one end 511/1 of the second elastic component 511*l* may have a hook shape, and the end connection component 210/2 may be further provided with a mounting portion 210/22. One end 511/1 of the second elastic component 511*l* may match the mounting portion 210/22 to prevent the second elastic component 511*l* from being released from the end connection component 210/2. In the above embodiment, the mounting portion 511*l* and the protruding posts 213*l* provided in the outer circumferential direction of the end connection component 210/2 may be two parts on the end connection component 210/2. The protruding posts may be used to transmit force in cooperation with the hub 510*l*.

Figure 46:
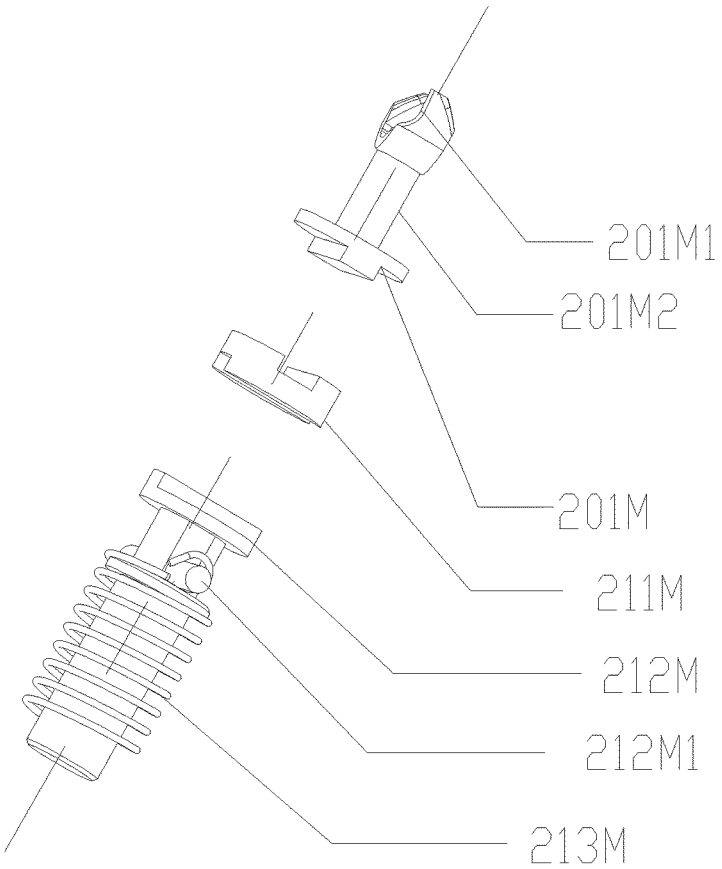
FIG. 46 illustrates an assembly structure of a force receiving element and a cross-coupling part provided by another embodiment of the present disclosure.

Another embodiment of the present disclosure provides another force receiving element and a processing cartridge including the force receiving element. As illustrated in FIG. 46, the force receiving element 201M may include a force receiving part 201M1, an abutting part 201M2, a first cross-coupling part 211M and the second cross-coupling part 212M. The force receiving part 201M1 may be capable of being engaged with a rotational driving force transmission part on the electronic imaging component. The first cross-coupling part 211M, the second cross-coupling part 212M, and the force receiving element 201M may together form a cross-coupling structure, so that the force receiving element 201M may be capable of translating in an radial direction with respect to a rotation axis of the force receiving element. The second cross-coupling part 212M may further include protruding posts 212M1, and the protruding posts 212M1 may be connected to the first elastic part 213M. Preferably, the first elastic part 213M may be a torsion spring. The first cross-coupling part 211M may be configured as an intermediate connection component, and the second cross-coupling part 212M may be configured as an end connection component.

Figure 47:
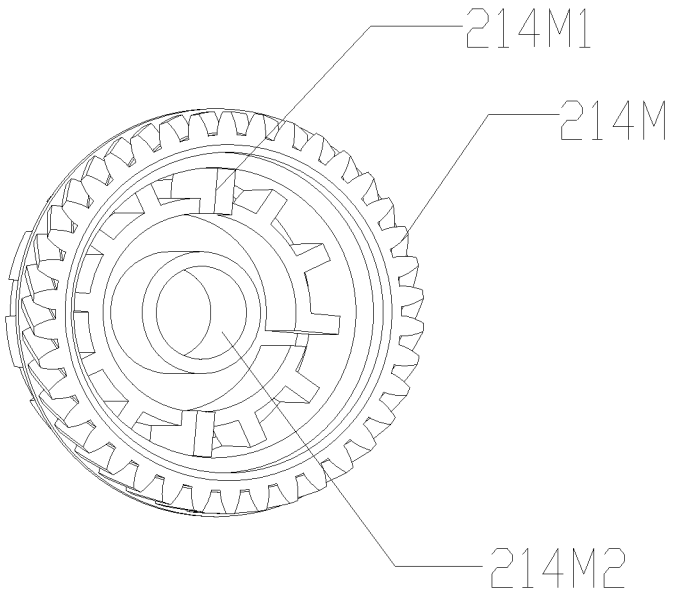
FIG. 47 illustrates a structure of a hub.

As shown in FIG. 47, protruding blocks 214M1 and support seats 214M2 may be disposed inside a hub 214M. The support seats 214M2 may support the second cross-coupling part 212M. An end of the second cross-coupling part 212M away from the force receiving element 201M may be inserted into the support seat 214M2. Due to the existence of the protruding posts 212M1, the protruding posts and the support seat 214M2 may interfere with each other, thereby the position of the protruding posts in the axial direction may be limited. The protruding posts 212M1 may also abut against the protruding blocks 214M1, so that the hub 214M may be capable of being driven to rotate by the combined structure of the force receiving element and the cross-coupling. Preferably, in order to prevent the protruding blocks 214M1 or the protruding posts 212M1 from being broken to affect force transmission, the protruding posts 212M1 and the protruding blocks 214M1 may be both configured as two symmetrical parts with respect to the rotation axis of the force receiving element. One end of the first elastic part 213M may be connected to the protruding posts 212M1 and another end may be connected to the hub 214M, so that the second cross-coupling part 212M can be reset in the hub 214M without being subjected to external force. Preferably, when the first elastic part 213M urges the second cross-coupling part 212M to resets the second cross-coupling part 212M in the hub, the positional relationship between the protruding posts 212M1 and the protruding blocks 214M1 may be orthogonal. The present embodiment can make the second cross-coupling rotate 212M have a relatively large amount of space before the protruding posts 212M1 and the protruding block 214M1 abut against each other and transmit force, whether the second cross-coupling rotate 212M rotate clockwise or counterclockwise. Preferably, the outside of the hub 214M may be fixed to a photosensitive element (photosensitive drum).

Figure 44:
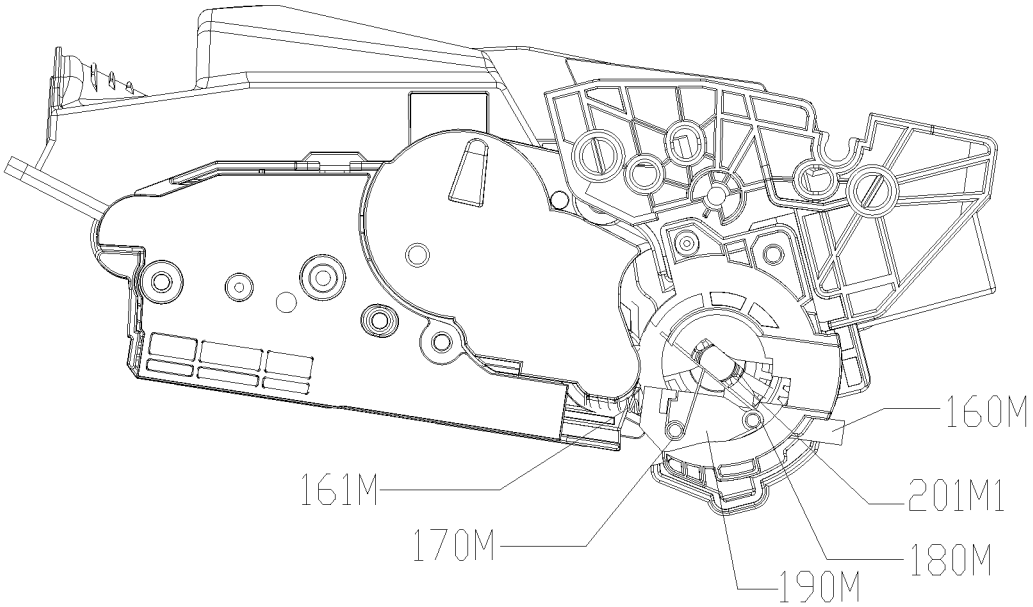
FIG. 44 illustrates a structure of a side wall of an exemplary processing cartridge where a force receiving element is disposed provided by another embodiment of the present disclosure.
Figure 45:
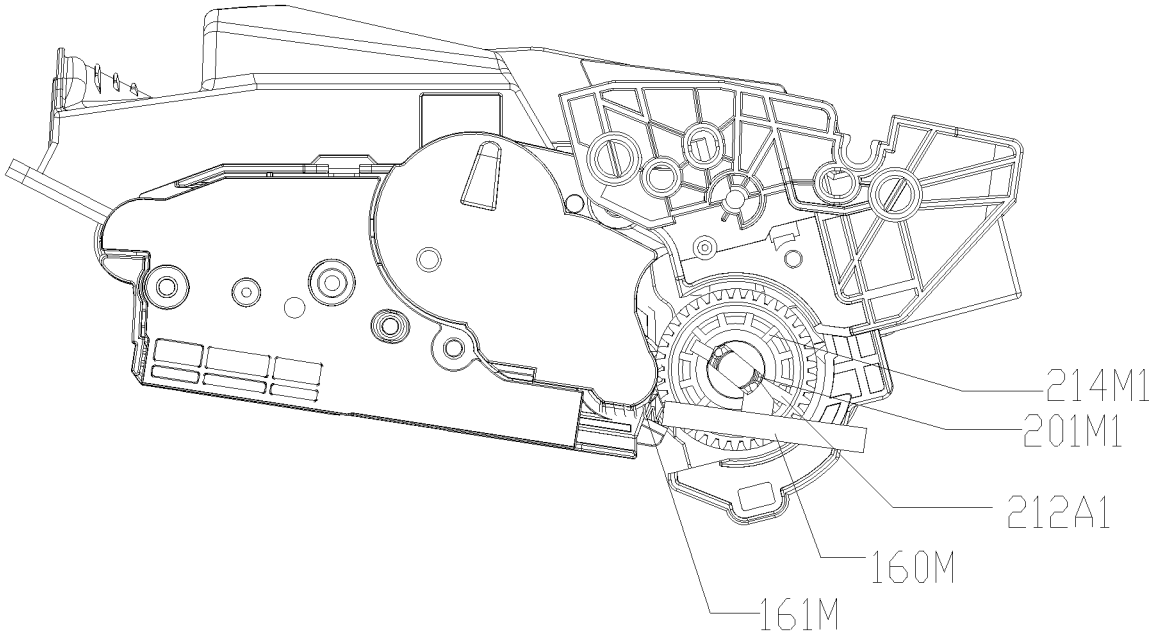
FIG. 45 illustrates a structure of a side wall of an exemplary processing cartridge where a force receiving element is disposed after removing an end cover provided by another embodiment of the present disclosure.

As shown in FIG. 44 and FIG. 45, the force receiving element may include a push rod 160M and a second elastic part 161M. The second elastic part 161M may push the push rod 160M to reset. Preferably, the second elastic part 161M may be a compression spring. The push rod 160M may abut against the abutting part 201M2, thereby pushing the force receiving element 201M to translate relative to the side wall of the processing cartridge. The force receiving element may further include a third elastic part 170M, and the third elastic part 170M may be disposed on the end cover 190M. Preferably, the third elastic part 170M may be a torsion spring. One end of the torsion spring may be fixed to the end cover 190M, and another end may be fixed to the force receiving element 201M. The third elastic part 170M may push the force receiving element 201M in a clockwise direction. The end cover 190M may limit the combination structure of the force receiving element and the cross-coupling, so that the combination structure of the force receiving element and the cross-coupling cannot be extended and contracted in the axial direction of the force receiving element. The end cover 190M may further include a guide part 180M, and the guide member 180M may abut against the abutting portion 201M2 to make the force receiving element 201M movable in the direction of the guide part. Preferably, the guide member 180M may be an elastic part, and is referred to as a fourth elastic part. Preferably, the fourth elastic part may be a torsion spring. The fourth elastic part may abut against the end cover 190M, therefore sides where the fourth elastic part is in contact with the abutting portion 201M2 cannot be forced to push the abutting portion 201M2 in a clockwise direction. Or the fourth elastic part may be fixed at the end cover 190M, therefore the side where the fourth elastic part is in contact with the abutting portion 201M2 cannot push the abutting portion 201M2 in the clockwise direction.

When the processing cartridge is not mounted in the electronic imaging device, the push rod 160M may extend outward, and the third elastic part 170M may push the force receiving element 201M along the guide part 180M toward the right lower position in the viewing angle in FIG. 44. Eventually, the force receiving element 201M may abut with the parts on the force receiving element and stop. A position of the processing cartridge is referred to as a first position at this time. After the processing cartridge is mounted in the electronic imaging device, the push rod 160M may abut against the electronic imaging device and may retract into the processing cartridge. Then the push rod may push the force receiving element 201M moving along the guide part 180M toward an upper right position in the viewing angle in FIG. 44 and to be engaged with the rotational driving force transmission component of the electronic imaging device. A position of the processing cartridge is referred to as a second position at this time.

Figure 48A:
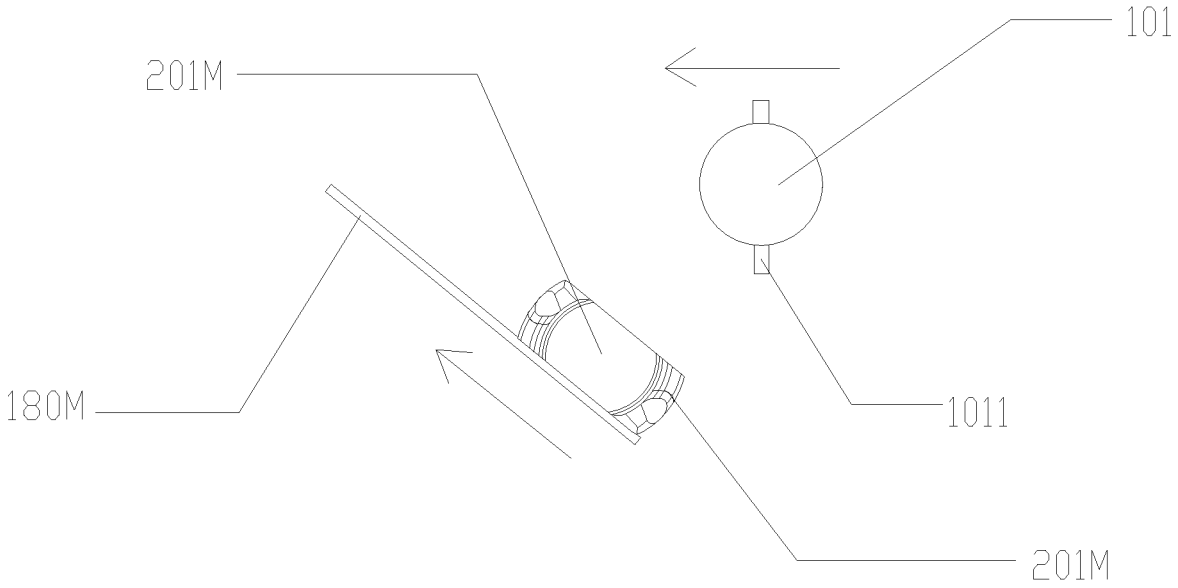
FIGS. 48*a*-48*c* illustrate structures corresponding to different steps of a process that a force receiving element is engaged with a rotating driving force transmission component.
Figure 48B:
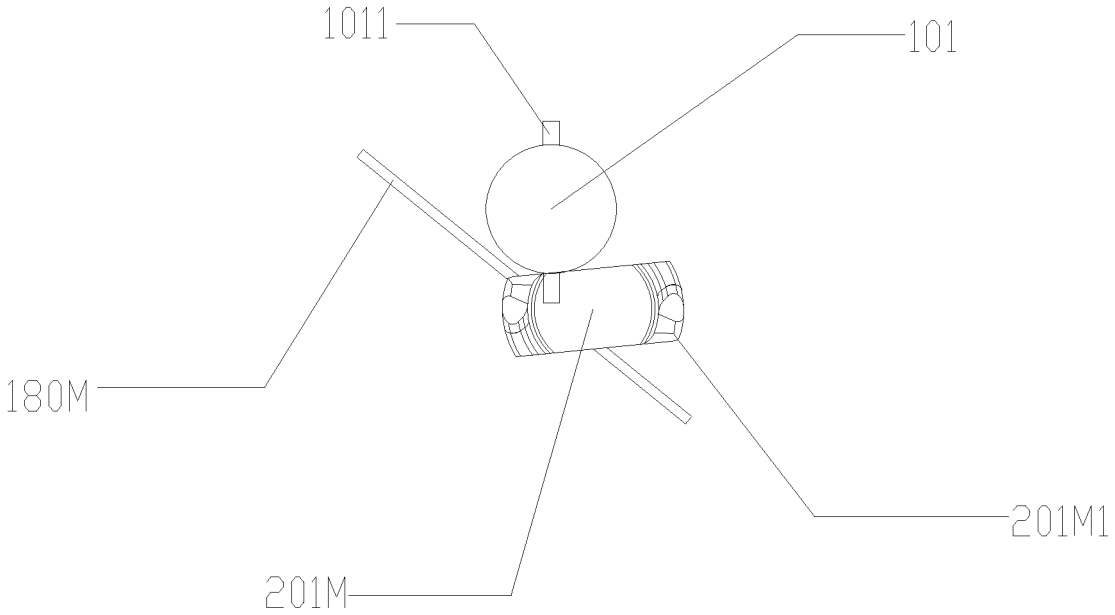
Figure 48C:
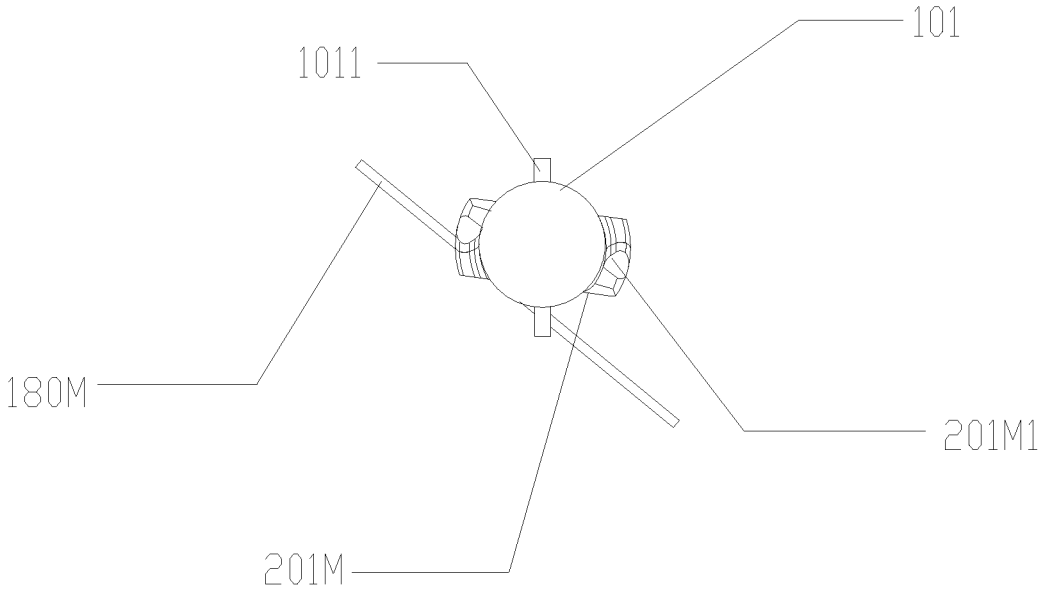

FIG. 48*a* to FIG. 48*c* illustrate a process for engaging the force receiving element 201M with the rotational driving force transmitting component 101. The plane of the figures is parallel to the side wall of the processing cartridge. As shown in FIG. 48*a*, the rotary driving force transmission component 101 may include engaging protrusions 1011. When the processing cartridge is mounted in the electronic imaging device, the push rod 160M (not shown) may push the force receiving element 201M to move from the first position along the guide component 180M to the upper left direction of FIG. 48*a*. At the same time, the processing cartridge may be installed inward, which is equivalent to the leftward movement of the rotational driving force transmission component. As the movement continues, as shown in FIG. 48*b*, the engaging protrusions 1011 may abut against the force receiving portion 201M, and push the force receiving element 201M to rotate. Since the guide component has a large elastic force, the guide component 180M will not move at this time. As shown in FIG. 48*c*, the force receiving element 201M and the rotational driving force transmitting component 101 may continue to move and finally be engaged with each other. It may be now in the second position. Normally, the rotational driving force transmission component 101 may be directly engaged with the force receiving element 201M or may be engaged with the force receiving element 201M after the force receiving element 201M is rotated.

Figure 49A:
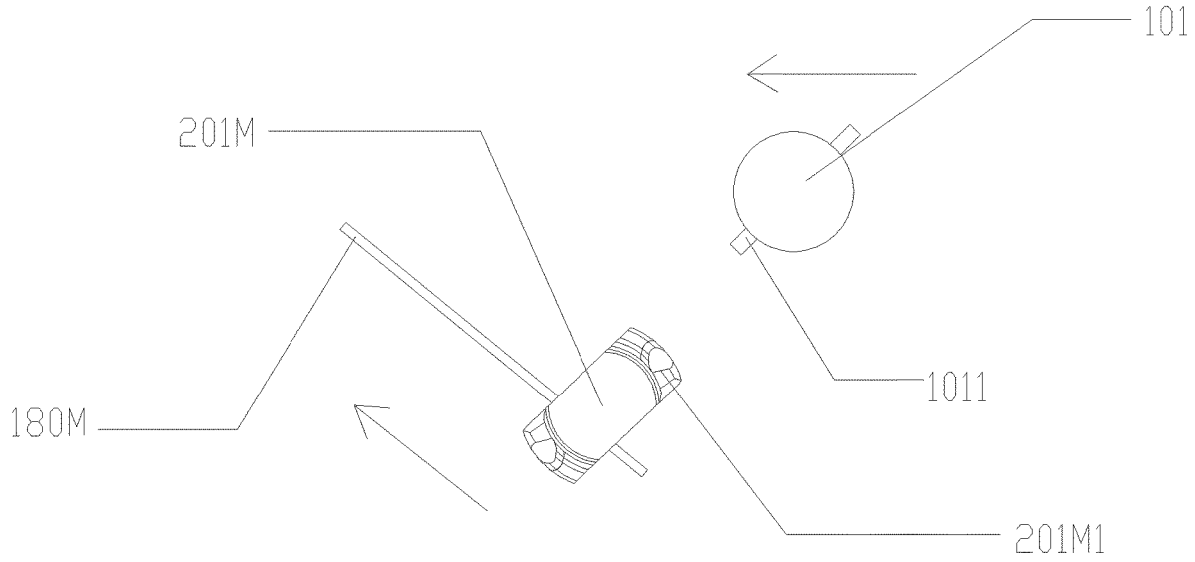
FIGS. 49*a*-49*c* illustrate structures corresponding to different steps of another process that a force receiving element is engaged with a rotating driving force transmission component.
Figure 49B:
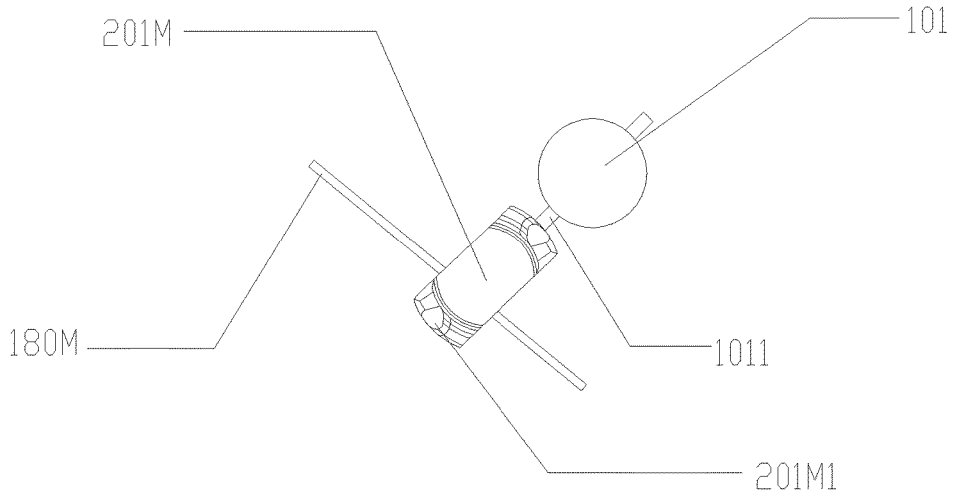
Figure 49C:
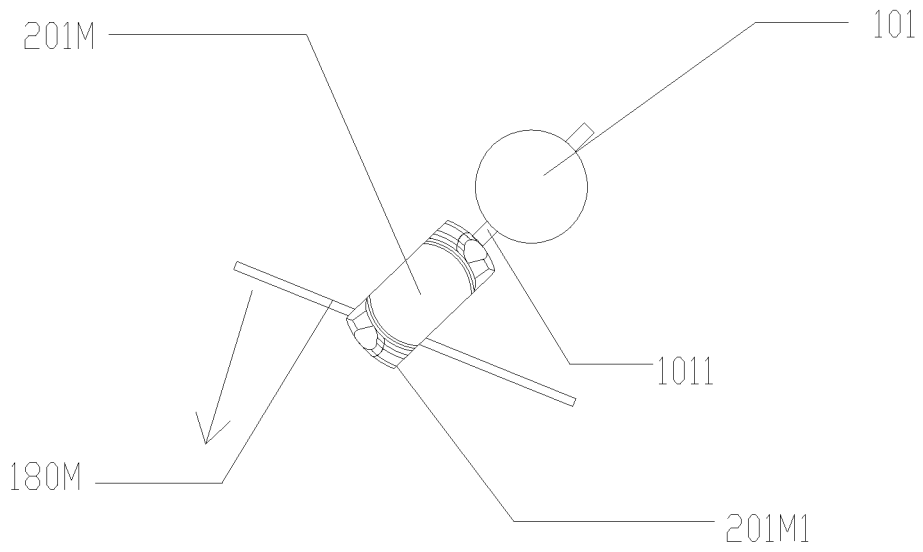

FIG. 49*a* to FIG. 49*c* another process for engaging the force receiving element 201M with the rotational driving force transmitting component 101. Like FIG. 48*a* to FIG. 48*c*, the plane of the schematic diagram is parallel to the side wall of the processing cartridge. As shown in FIG. 49*a*, the rotary driving force transmission component 101 may include engaging protrusions 1011. When the processing cartridge is installed in the electronic imaging device, a push rod 160M (not shown) may push the force receiving element 201M to move from the first position along the guide component 180M to the upper left direction of FIG. 48*a*. At the same time, the processing cartridge may be installed inward, which is equivalent to the leftward movement of the rotational driving force transmission component. As the movement continues, as shown in FIG. 49*b*, the engaging protrusions 1011 may be stuck with the force receiving part. At this time, the force receiving element 201M cannot be pushed and rotated by the engaging projection 1011. If the guide component is set as a fixed inclined surface, a collision will occur at this position, which will affect the smoothness of the installation and even cause damage to each component. Therefore, as shown in FIG. 49*c*, the guide component 180M may be configured as the fourth elastic component and may be capable of being shifted downward by a certain extent, so that the rotation driving force transmission component 101 may rotate to avoid the stuck position and to be engaged with the force receiving element 201M to reach FIG. 48*c*. The state is now in the second position.

In the present disclosure, the force receiving element may be relatively fixed to the processing cartridge housing in the longitudinal direction of the processing cartridge. That is, the force receiving element may be substantially no displacement in the longitudinal direction. When the processing cartridge is mounted into the electronic imaging device along the predetermined installation direction, the driving component may include the transmission part, and the force receiving element may include the force receiving parts. If the projection of the driving component along the installation direction is less than or equal to the gap between the two force receiving parts, the force receiving parts can be engaged with the transmission part on the driving component. If the projection of the driving component along the installation direction is larger the gap between the two force receiving parts, the force receiving parts may abut against the driving component and may be engaged with the driving by the rotation of the driving component. At the same time, when the processing cartridge is mounted along the mounting direction, the driving component may abut against the force receiving parts and make the axis of the force receiving element in a direction away from the axis of the hub. The rotation of the driving component may make the axis of the force receiving element move in a direction close to the axis of the hub. That is, during the process of mounting the processing cartridge along the mounting direction, the driving component may abut against the force receiving parts and make the force receiving element move in a first direction perpendicular to the axis of the hub. When the driving component rotates, the transmission part disposed on the driving component may abut against the force receiving parts of the force receiving element and hook the force receiving parts to make the force receiving element move in a second direction substantially opposite to the first direction, and then realize the engagement between the transmission part on the driving component and the force receiving parts on the force receiving element to transmit force.

In the present disclosure, the same functions in the existing technologies may be achieved more smoothly through a simpler structure, which can simplify the structure of the technical solution, reduce the cost, simplify the operation process, make the function more stable.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the above described embodiments, the present disclosure is not limited to the above described embodiments but may be embodied in other equivalent forms without departing from the scope of the present disclosure, which is determined by the appended claims.

What is claimed is:

1. A processing cartridge detachably mounted in an electronic imaging device that includes a driving component for transmitting rotating force, the processing cartridge comprising:

a housing, wherein the housing includes a hub; and a force receiving element, wherein:

the force receiving element is disposed at one side of the housing, and is rotatably supported by the housing;

the force receiving element is movably connected to the hub in a direction perpendicular to an axis direction of the hub;

the force receiving element includes force receiving parts;

the force receiving parts are disposed at an end portion of the force receiving element along a circumferential direction of the force receiving element, and protrude in a direction of a rotation axis of the force receiving element; and when the processing cartridge is mounted in the electronic imaging device along a predetermined mounting direction, the force receiving parts and the driving component are engaged with each other to transmit force;

wherein:

the force receiving element includes two force receiving parts;

the two force receiving parts are disposed at the end portion of the force receiving element symmetrically with respect to the circumferential direction of the force receiving element, and protrude in the direction of the rotation axis of the force receiving element and when the processing cartridge is mounted in the electronic imaging device in the predetermined mounting direction, if a projection of the driving component in the mounting direction is less than or equal to a gap between the two force receiving parts, the force receiving parts are capable of engaging with the driving component if the projection of the driving component in the mounting direction is larger than the gap between the two force receiving parts, the force receiving parts are capable of abutting against the driving component, and are capable of engaging with the driving component by a rotation of the driving component;

the force receiving element is disposed in the hub along the axis direction of the hub:

when the processing cartridge is mounted to the electronic imaging device in the mounting direction and the projection of the driving component in the mounting direction is larger than the gap between the two force receiving parts, the force receiving parts abut against the driving component and make the force receiving element move in the direction perpendicular to the axis of the hub;

wherein:

the force receiving element is connected to the hub through a cross-coupling structure;

the cross-coupling structure includes an intermediate connection component and an end connection component;

one end of the intermediate connection component is slidably connected to the force receiving element;

another end of the intermediate connection component is slidably connected to the end connection component;

the end connection component is connected to the hub;

wherein:

the end connection component includes protruding posts on an outer circumference of the end connection component;

the hub includes hub force receiving parts along an inner circumferential direction;

the protruding posts abut against the hub force receiving parts to transmit force;

the protruding posts protrude outwards in a radial direction of the end connection component;

the hub force receiving parts are disposed in the inner circumferential direction of the hub;

a second elastic component is further disposed between the end connection component and the hub; and when the end connection component and the hub are not subjected to external force, the second elastic component prevents the protruding posts and the hub force receiving parts from abutting against each other;

wherein:

a mounting part is further disposed on the outer circumference of the end connection component;

the second elastic component is a torsion spring component; and one end of the torsion spring component is connected to the mounting part, and another end abuts against the hub.

2. The processing cartridge according to claim 1, wherein:

when the processing cartridge is mounted to the electronic imaging device in the mounting direction, the driving component abuts against the force receiving parts and make the axis of the force receiving element move in a direction away from the axis of the hub; and the driving component rotates to make the axis of the force receiving element shift in a direction closer to the axis of the hub, and make the force receiving parts engage with the driving component.

3. The processing cartridge according to claim 1, further including a first elastic component, wherein:

one end of the first elastic component abuts against the housing or a part fixed with respect to the housing;

another end of the first elastic component abuts against the force receiving element; and the first elastic component is capable of applying pulling force or pushing force on the force receiving element.

4. The processing cartridge according to claim 3, wherein:

the first elastic component is a tension spring, a spring, or a torsion spring.

5. The processing cartridge according to claim 3, further including an end cover, wherein:

the end cover is disposed on one side of the housing;

the first elastic component is disposed on the end cover; and one end of the first elastic component is connected to the end cover, and another end is connected to the force receiving element.

6. A processing cartridge detachably mounted in an electronic imaging device that includes a driving component for transmitting rotating force, the processing cartridge comprising:

a housing; and a force receiving element, wherein:

the force receiving element is disposed at one side of the housing, and is rotatably supported by the housing;

the force receiving element includes force receiving parts;

the force receiving parts are disposed at an end portion of the force receiving element along a circumferential direction of the force receiving element, and protrude in a direction of a rotation axis of the force receiving element;

when the processing cartridge is mounted in the electronic imaging device along a predetermined mounting direction, the force receiving parts and the driving component are engaged with each other to transmit force, when the processing cartridge is mounted into the electronic imaging device, the force receiving element is engaged with the driving component; and when the processing cartridge is removed from the electronic imaging device, the housing of the processing cartridge is tilted with respect to an axis of the driving component to remove engagement between the force receiving element and the driving component.

7. The processing cartridge according to claim 6, wherein:

the force receiving element includes two force receiving parts;

the two force receiving parts are disposed at the end portion of the force receiving element symmetrically with respect to the circumferential direction of the force receiving element, and protrude in the direction of the rotation axis of the force receiving element; and when the processing cartridge is mounted in the electronic imaging device in the predetermined mounting direction, if a projection of the driving component in the mounting direction is less than or equal to a gap between the two force receiving parts, the force receiving parts are capable of engaging with the driving component; if the projection of the driving component in the mounting direction is larger than the gap between the two force receiving parts, the force receiving parts are capable of abutting against the driving component, and are capable of engaging with the driving component by a rotation of the driving component.

8. The processing cartridge according to claim 7, wherein:

the housing includes a hub therein;

the force receiving element is disposed in the hub along an axis direction of the hub;

the force receiving element is movably connected to the hub in a direction perpendicular to the axis direction of the hub; and when the processing cartridge is mounted to the electronic imaging device in the mounting direction and the projection of the driving component in the mounting direction is larger than the gap between the two force receiving parts, the force receiving parts abut against the driving component and make the force receiving element move in the direction perpendicular to the axis of the hub.

9. The processing cartridge according to claim 8, wherein:

when the processing cartridge is mounted to the electronic imaging device in the mounting direction, the driving component abuts against the force receiving parts and make the axis of the force receiving element move in a direction away from the axis of the hub; and the driving component rotates to make the axis of the force receiving element shift in a direction closer to the axis of the hub, and make the force receiving parts engage with the driving component.

10. The processing cartridge according to claim 8, wherein:

the force receiving element is connected to the hub through a cross-coupling structure;

the cross-coupling structure includes an intermediate connection component and an end connection component;

one end of the intermediate connection component is slidably connected to the force receiving element;

another end of the intermediate connection component is slidably connected to the end connection component; and the end connection component is connected to the hub.

11. The processing cartridge according to claim 8, further including a first elastic component, wherein:

one end of the first elastic component abuts against the housing or a part fixed with respect to the housing;

another end of the first elastic component abuts against the force receiving element; and the first elastic component is capable of applying pulling force or pushing force on the force receiving element.

12. The processing cartridge according to claim 11, wherein:

the first elastic component is a tension spring, a spring, or a torsion spring.

13. The processing cartridge according to claim 10, wherein:

the end connection component includes protruding posts on an outer circumference of the end connection component;

the hub includes hub force receiving parts along an inner circumferential direction;

the protruding posts abut against the hub force receiving parts to transmit force;

the protruding posts protrude outwards in a radial direction of the end connection component;

the hub force receiving parts are disposed in the inner circumferential direction of the hub;

a second elastic component is further disposed between the end connection component and the hub; and when the end connection component and the hub are not subjected to external force, the second elastic component prevents the protruding posts and the hub force receiving parts from abutting against each other.

14. The processing cartridge according to claim 13, wherein:

a mounting part is further disposed on the outer circumference of the end connection component;

the second elastic component is a torsion spring component; and one end of the torsion spring component is connected to the mounting part, and another end abuts against the hub.

15. The processing cartridge according to claim 11, further including an end cover, wherein:

the end cover is disposed on one side of the housing;

the first elastic component is disposed on the end cover; and one end of the first elastic component is connected to the end cover, and another end is connected to the force receiving element.

* * * * *